US012256814B2

(12) United States Patent
Maruyama et al.

(10) Patent No.: US 12,256,814 B2
(45) Date of Patent: Mar. 25, 2025

(54) CONNECTION STRUCTURE AND WEARABLE DEVICE

(71) Applicant: CASIO COMPUTER CO., LTD., Tokyo (JP)

(72) Inventors: Yoshihiro Maruyama, Hamura (JP); Masao Amano, Uenohara (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 85 days.

(21) Appl. No.: 18/075,660

(22) Filed: Dec. 6, 2022

(65) Prior Publication Data

US 2023/0172324 A1 Jun. 8, 2023

(30) Foreign Application Priority Data

Dec. 6, 2021 (JP) ..... 2021-197438
May 20, 2022 (JP) ..... 2022-082671

(51) Int. Cl.
*A44C 5/14* (2006.01)
*A44C 5/10* (2006.01)

(52) U.S. Cl.
CPC ..... *A44C 5/14* (2013.01); *A44C 5/105* (2013.01); *Y10T 24/4782* (2015.01)

(58) Field of Classification Search
CPC ..... A44C 5/147; A44C 5/14; G04B 37/16; G04B 37/1486; Y10T 24/2155; Y10T 24/4782; Y10T 24/4718
See application file for complete search history.

(56) References Cited

U.S. PATENT DOCUMENTS 4,432,655 A * 2/1984 Wollman ..... G04B 37/1486 368/282
6,449,812 B1 * 9/2002 Calce ..... G04B 37/1486 224/164

(Continued)

FOREIGN PATENT DOCUMENTS

JP 2004294284 A 10/2004
JP 2007082597 A 4/2007

(Continued)

OTHER PUBLICATIONS

Notice of Reasons for Refusal dated Oct. 17, 2023 received in Japanese Patent Application No. JP 2022-082671.

(Continued)

*Primary Examiner* — Robert Sandy
*Assistant Examiner* — Michael S Lee
(74) *Attorney, Agent, or Firm* — Scully, Scott, Murphy & Presser, P.C.

(57) ABSTRACT

A connection structure includes: a connection pin that includes a first part and a second part between which a step is formed and that connects a first target and a second target by being inserted in an insertion hole; and a pin locker movable in a moving direction in a recess formed in either the first or second target. The pin locker has a pin engaging part that engages with the step of the connection pin and a pin insertion part. One of the recess and the pin locker has a first abutting part, and another has a first abutted part. When the pin locker is at a specific position and the first abutting part abuts the first abutted part, at least either an orientation or a position of the pin insertion part is limited such that the second part is allowed to pass through the pin insertion part.

18 Claims, 11 Drawing Sheets

(56) References Cited

U.S. PATENT DOCUMENTS

| | | | | |
|---|---|---|---|---|
| 2020/0093229 | A1* | 3/2020 | Guyot | A44C 5/107 |
| 2023/0141715 | A1* | 5/2023 | Christian | G04B 37/1493<br>368/282 |
| 2023/0176528 | A1* | 6/2023 | Maruyama | A44C 5/14<br>368/282 |
| 2024/0188693 | A1* | 6/2024 | Christian | A44C 5/14 |

FOREIGN PATENT DOCUMENTS

| | | | |
|---|---|---|---|
| JP | 3194514 | U | 11/2014 |
| JP | 2020512891 | A | 4/2020 |
| WO | 2018189219 | A1 | 10/2018 |

OTHER PUBLICATIONS

Official Action dated Feb. 8, 2024 received in European Patent Application No. EP 22203008.2.

* cited by examiner

CONNECTION STRUCTURE AND WEARABLE DEVICE

CROSS-REFERENCE TO RELATED APPLICATIONS

This application is based upon and claims the benefit of priority of Japanese Patent Applications No. 2021-197438 filed on Dec. 6, 2021 and No. 2022-082671 filed on May 20, 2022, the entire disclosure of which is incorporated herein by reference in its entirety.

TECHNICAL FIELD

The present disclosure relates to a connection structure and a wearable device.

Technological Field

Various known connection structures are used to connect a main body of a wearable device (e.g., wristwatch) and a band or to connect links constituting the band. One of typical connection structures connects two members (connection targets) by using a connection pin inserted in a through hole that penetrates through the two members. This type of connection structure is disclosed in JP2007-82597A. According to JP2007-82597A, the connection pin has an engaging depression part formed one round around the pin in the direction of the outer circumference. The engaging depression part engages with an end of a pin locking member that is movable in the direction perpendicular to the connection pin, so that the connection pin is locked and unable to escape from the through hole.

Instead of the above configuration, in which the engaging depression part engages with the end of the pin lock member, the following configuration is also conceivable: the pin lock member has a pin insertion part (e.g., a hole that penetrates through the pin lock member) having a size that allows the connection pin to pass through; the pin lock member is moved in the direction perpendicular to the connection pin between (i) the locking position where the edge of the pin insertion part locks the engaging depression part of the connection pin and (ii) the unlocking position where the entire connection pin can pass through the pin insertion part. According to such a configuration, the state of the connection pin can be switched between the locked state and the unlocked state.

SUMMARY

According to an embodiment of the present invention, a connection structure includes: a connection pin that includes a first part and a second part between which a step is formed, the second part being thicker than the first part, and that connects a first connection target and a second connection target by being inserted in an insertion hole of the first connection target and an insertion hole of the second connection target; and a pin locker that is movable in a moving direction in a recess formed in one of the first connection target and the second connection target, the moving direction being different from a direction in which the through hole of the one of the first connection target and the second connection target extends, that has a pin engaging part that is configured to engage with the step of the connection pin, and that has a pin insertion part having a size that allows the connection pin to pass through, a part of an edge of the pin insertion part being the pin engaging part, wherein: one of the recess and the pin locker has a first abutting part, and another of the recess and the pin locker has a first abutted part to be abutted by the first abutting part, and when the pin locker is at a specific position in the moving direction and when the first abutting part abuts the first abutted part, at least either an orientation of the pin insertion part with respect to the insertion hole or a position of the pin insertion part on a plane perpendicular to the moving direction is limited such that the second part of the connection pin being inserted in the insertion hole is allowed to pass through the pin insertion part.

According to another embodiment of the present invention, a wearable device includes: a device main body as the first connection target; a band as the second connection target to be used for attaching the device main body to an object; and the connection structure.

BRIEF DESCRIPTION OF THE DRAWINGS

The accompanying drawings are not intended as a definition of the limits of the invention but illustrate embodiments of the invention, and together with the general description given above and the detailed description of the embodiments given below, serve to explain the principles of the invention, wherein.

DESCRIPTION OF EMBODIMENTS

Hereinafter, an embodiment of the present invention is described with reference to the drawings.

Configuration of Timepiece

Figure 1:
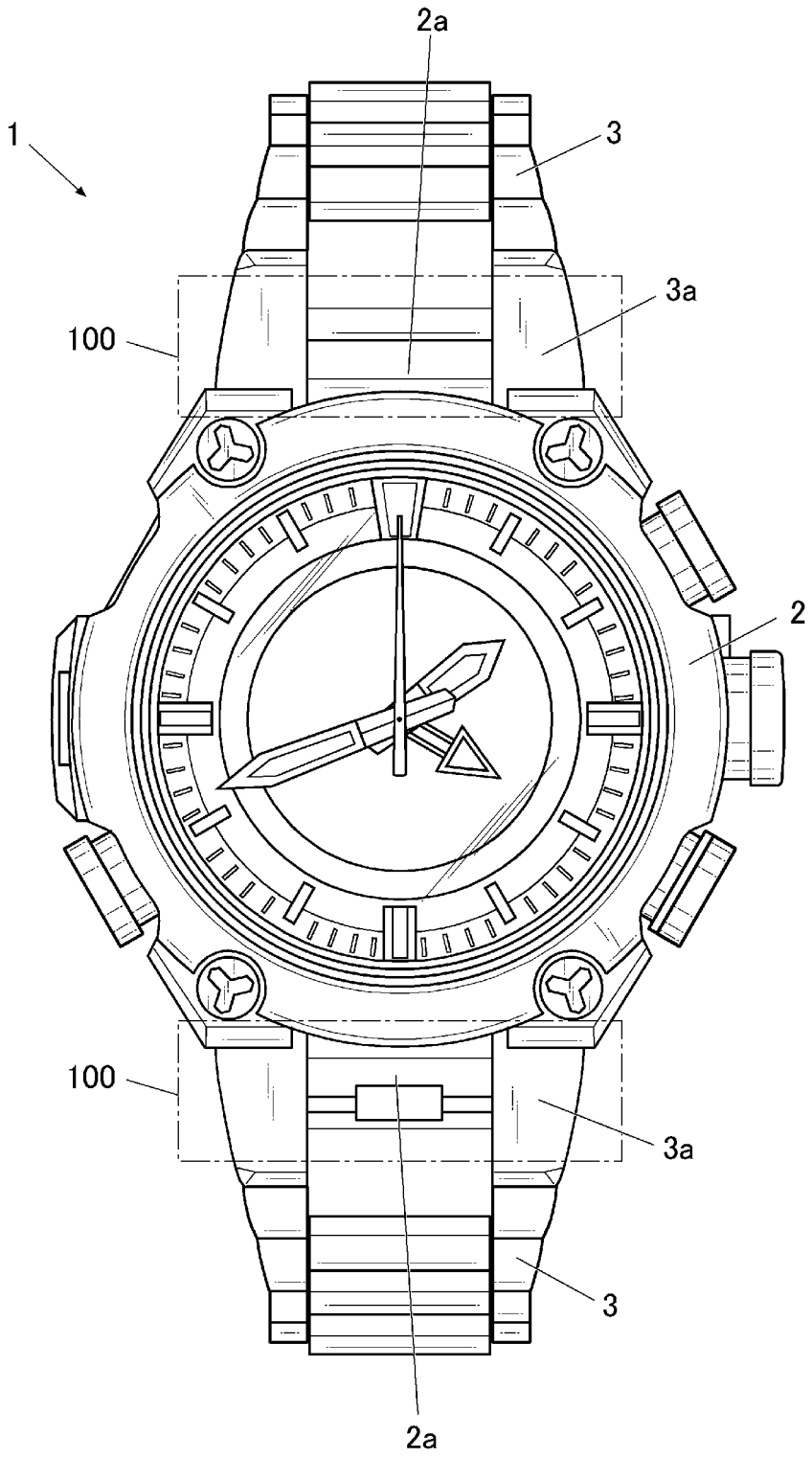
FIG. 1 shows a configuration of a timepiece.

FIG. 1 shows a configuration of a timepiece 1 in this embodiment.

The timepiece 1 (wearable device) is a wristwatch that includes a device main body 2 and a belt-shaped (band-shaped) band 3 for attaching the timepiece 1 to the wrist. The device main body 2 includes an exterior member (case) and various components housed inside the exterior member, such as a dial, hands, and mechanism and circuits for moving the hands. Hereinafter, the front surface of the device main body 2 is the surface on which the hands are viewable, and the back surface of the device main body 2 is opposite the front surface. The device main body 2 includes two band attachment parts 2*a* at positions corresponding to 12 o'clock and 6 o'clock of the dial on the outer circumference of the external member. To the band attachment parts 2*a*, the band 3 is attached. The band 3 includes attachment end parts 3*a* that are attached to the respective two band attachment parts 2*a*. Each of the attachment end parts 3*a* may be one of links constituting the band 3. The timepiece 1 includes band connection structures 100 (connection structure) each of which connects the attachment end part 3*a* of the band 3 to the band attachment part 2*a*. That is, the band connection structure 100 connects the band 3 to the device main body 2. The timepiece 1 has two band connection structures 100 corresponding to the two band attachment parts 2*a*. Each of the band connection structures 100 connects the band 3 (attachment end part 3*a*) to the device main body 2 (band attachment part 2*a*) such that the band 3 is attachable to and detachable from the device main body 2 by the user's manipulation. The user can replace the band 3 according to his/her taste or the circumstance. In this embodiment, the device main body 2 is a first connection target, and the band 3 is a second connection target of the band connection structure 100.

In the structure disclosed by JP2007-82597A, the pin insertion part is formed in the pin lock member. When the orientation of the pin lock member (the orientation of the pin insertion part) is inappropriate, the connection pin cannot pass through the pin insertion part even if the pin locking member is at the unlocking position. To avoid such an issue, the pin lock member needs to be appropriately oriented and held before inserting the connection pin for connection. This requires time and effort. The band connection structure that addresses the above issue is described below.

Configuration of Band Connection Structure

Figure 2:
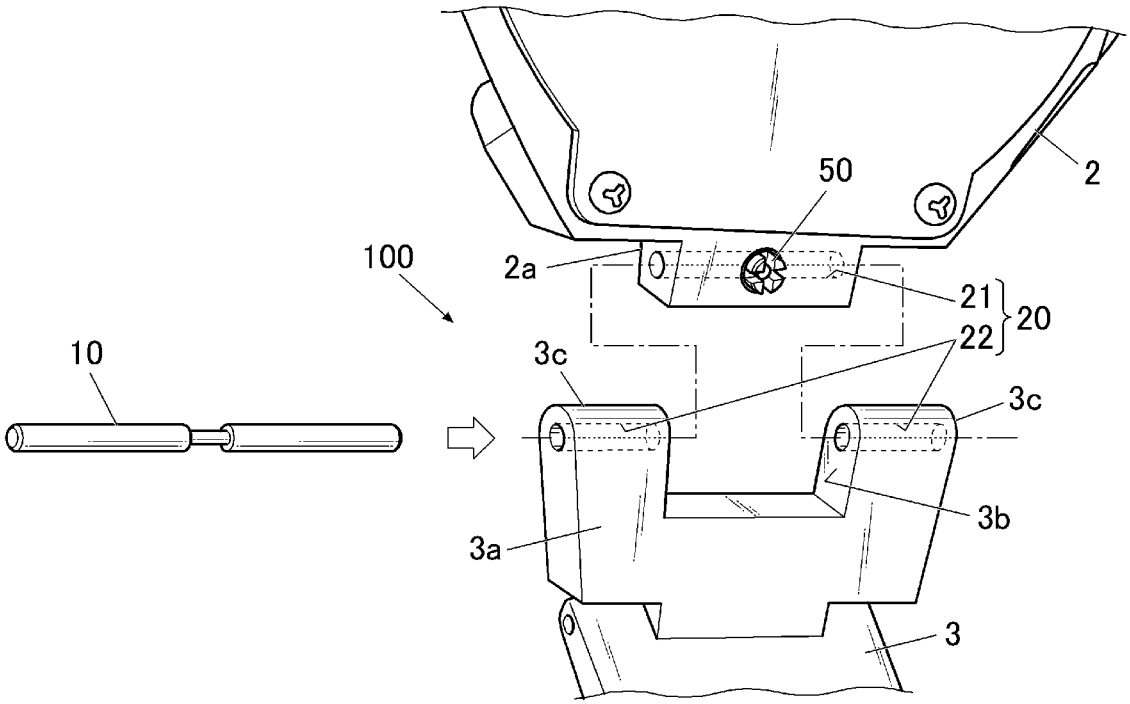
FIG. 2 shows a schematic configuration of a band connection structure.

FIG. 2 shows a schematic configuration of the band connection structure 100.

Each of the band attachment parts 2*a* of the device main body 2 protrudes from the outer circumference of the device main body 2, thereby forming a connection protrusion. Each of the attachment end parts 3*a* of the band 3 has a connection recess 3*b*. The connection recess 3*b* has a shape to fit to the band attachment part 2*a*. The attachment end part 3*a* has a pair of leading ends 3*c* that are separated by the connection recess 3*b*. Each of the leading ends 3*c* has a band-side insertion hole 22 (insertion hole) that extends in the direction of the width of the band 3. The band attachment part 2*a* has a device-main-body-side insertion hole 21 (insertion hole) that extends in the direction of the width of the band 3. When the band attachment part 2*a* fits in the connection recess 3*b* of the attachment end part 3*a*, the device-main-body-side insertion hole 21 connects through to the two band-side insertion holes 22 collinearly, thereby forming a continued through insertion hole 20 that passes through the band attachment part 2*a* and the attachment end part 3*a*. The band connection structure 100 includes a connection pin 10 that is inserted into the through insertion hole 20 to connect the band attachment part 2*a* and the attachment end part 3*a*. When the connection pin 10 is pulled out from the through insertion hole 20, the attachment end part 3*a* is disconnected from the band attachment part 2*a*.

The entire configuration of the band connection structure 100 is described with reference to FIG. 3 to FIG. 7.

Figure 3:
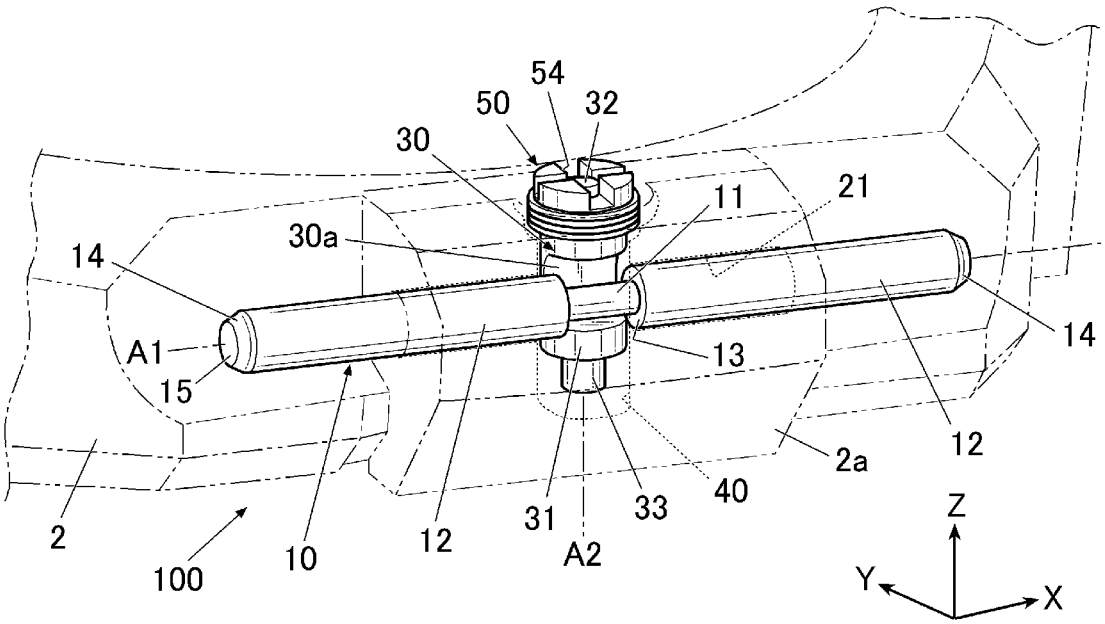
FIG. 3 shows a perspective view of the configuration of the band connection structure.
Figure 4:
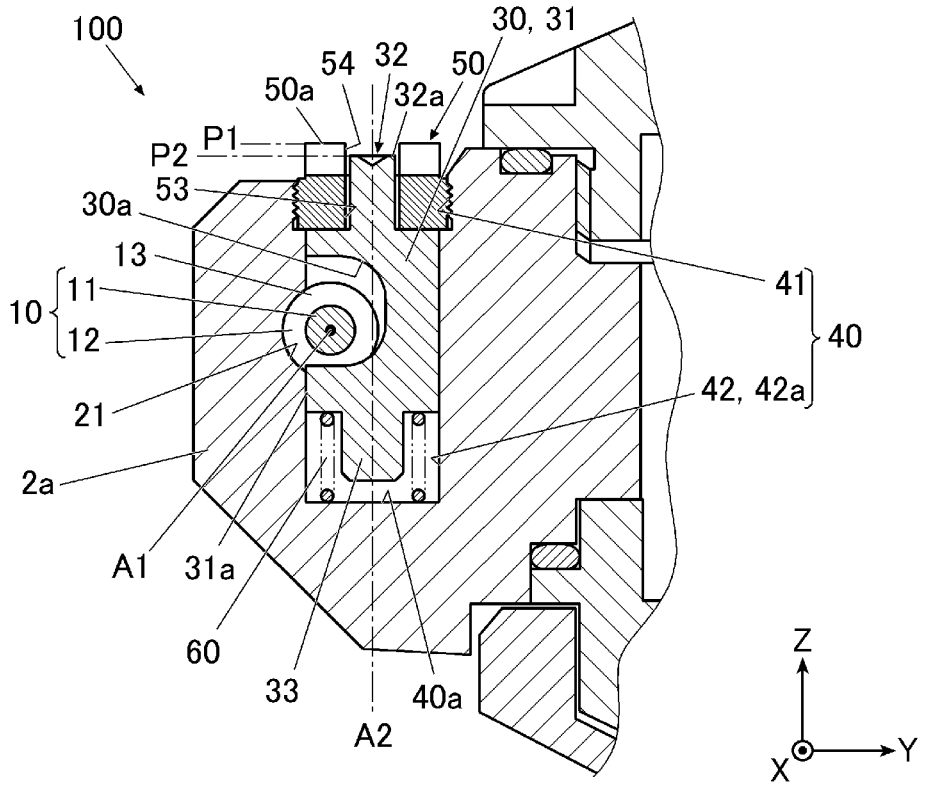
FIG. 4 shows a cross section of the band connection structure perpendicular to the X direction in a state where the connection pin is locked.
Figure 5:
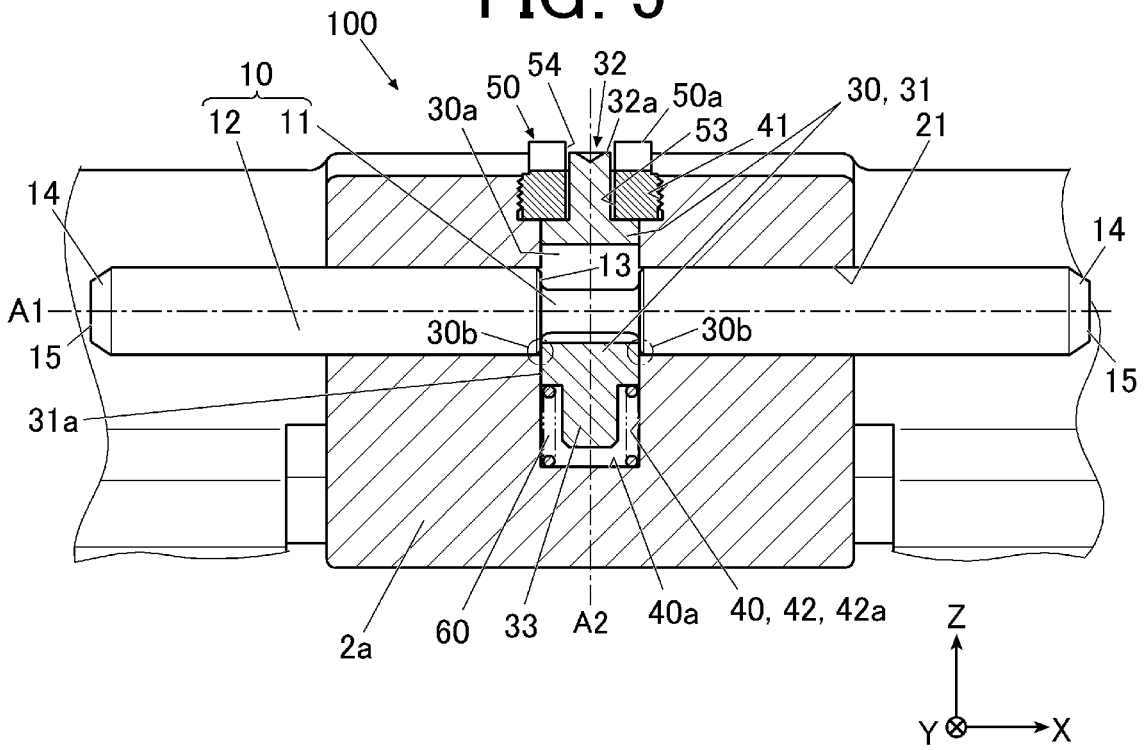
FIG. 5 shows a cross section of the band connection structure perpendicular to the Y direction in a state where the connection pin is locked.
Figure 6:
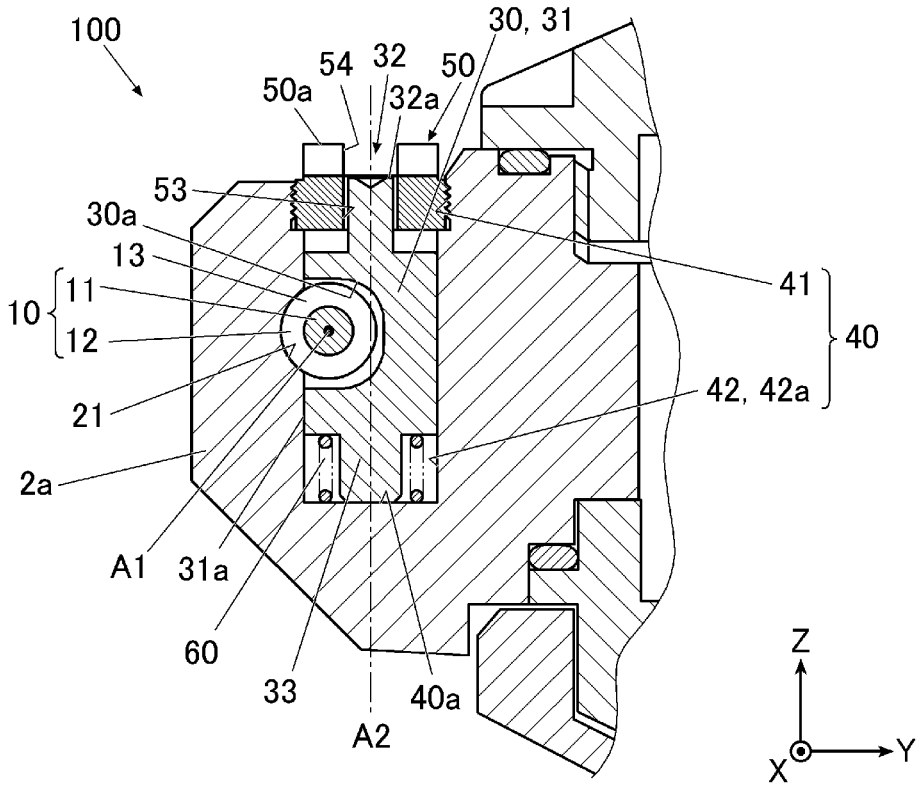
FIG. 6 shows a cross section of the band connection structure perpendicular to the X direction in a state where the connection pin is unlocked.
Figure 7:
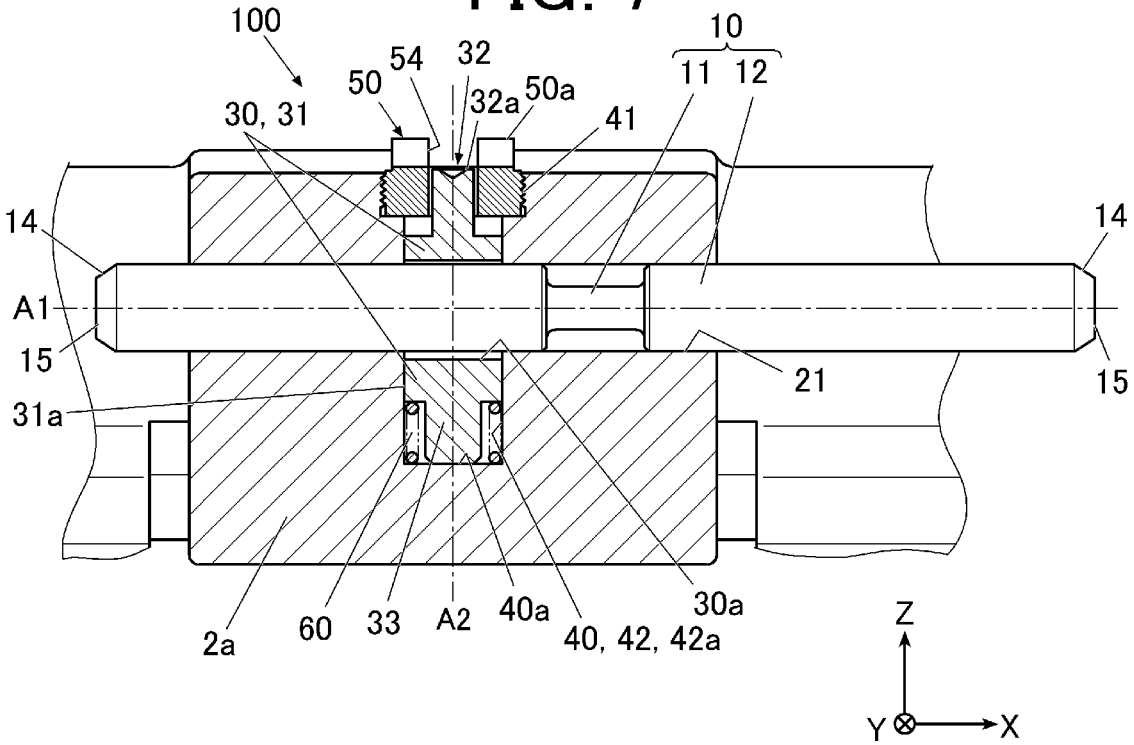
FIG. 7 shows a cross section of the band connection structure perpendicular to the Y direction in a state where the connection pin is unlocked.

FIG. 3 is a perspective view of the configuration of the band connection structure 100. In FIG. 3, the band 3 is not illustrated, and the device main body 2 is depicted as being transparent so as to clearly show the configuration of the band connection structure 100. In FIG. 3, the back surface of the device main body 2 faces upward. The orientations (directions) of components of the band connection structure 100 are described below on the basis of the X-Y-Z coordinate system. The X direction is parallel with the insertion axis A1 that passes through the center of the insertion hole 20. Herein, the insertion axis A1 is the central axis of the cross section of the through insertion hole 20, the cross section being perpendicular to the longitudinal direction of the device-main-body-side insertion hole 21 and the band-side insertion holes 22. The Z direction is parallel with the thickness direction of the device main body 2 and is the direction from the front surface toward the back surface of the device main body 2. The Y direction is perpendicular to the X and Z directions and is the direction from the band 3 toward the device main body 2. FIG. 4 and FIG. 6 show the cross section of the band connection structure 100 that is perpendicular to the X direction. FIG. 5 and FIG. 7 show the cross section of the band connection structure 100 that is perpendicular to the Y direction. FIG. 5 and FIG. 7 omit the band 3.

The band connection structure 100 includes the connection pin 10, a pin locker 30, a cap 50 (holder), and a spring 60 (bias). The spring 60 is not illustrated in FIG. 3. The band attachment part 2*a*, the attachment end part 3*a*, the connection pin 10, the pin locker 30, the cap 50, and the spring 60 may be made of metal, such as titanium alloy or stainless. The material of these components, however, is not limited to metal but may be any material having a strength equal to or greater than a certain level, such as resin. The band attachment part 2*a* has a recess 40. The recess 40 extends in the −Z direction from the back surface side of the band attachment part 2*a* and communicates with the device-main-body-side insertion hole 21. The direction in which the recess 40 extends is parallel with the Z direction and perpendicular to the insertion axis A1. The pin locker 30 and the spring 60 are disposed inside the recess 40 (housed in the recess 40). The cap 50 is attached to the opening end 41 of the recess 40 so as to be attachable to and detachable from the opening end 41. With the cap 50 attached, the pin locker 30 and the spring 60 are housed in the recess 40 so as not to escape from the recess 40. The pin locker 30 is movable in the Z direction in the recess 40. The cross sections shown in FIG. 4 to FIG. 7 are cut along the central axis A2 of the pin locker 30 housed in the recess 40. The central axis A2 is the central axis (center) of the cross section of the pin locker 30, the cross section being perpendicular to the moving direction.

The spring 60 is a helical compression spring, for example. The spring 60 is disposed between the bottom of the recess 40 and the pin locker 30. The spring 60 biases the pin locker 30 toward the cap 50 (toward the opening side of the recess 40). When no external force is applied to the pin locker 30, the pin locker 30 biased by the spring 60 is held in a state of abutting the cap 50. Thus, the cap 50 holds the pin locker 30 in cooperation with the spring 60. The cap 50 has an opening 53 that connects the inside and outside of the recess 40 (i.e., the opening 53 passes through the cap 50). Through the opening 53, the pin locker 30 can be pushed (moved) in the −Z direction against the elastic force of the spring 60. That is, the pin locker 30 is movable in a direction (Z direction) different from the direction in which the through insertion hole 20 extends (the direction of the insertion axis A1; X direction). The pin locker 30 has a pin insertion part 30*a* (cut-out part) that is sized to allow the connection pin 10 to pass through when the connection pin 10 is inserted into the device-main-body-side insertion hole 21 (through insertion hole 20). The pin insertion part 30*a* is formed on the insertion axis A1 side of the pin locker 30. The connection pin 10 has a substantially round-bar shape. The connection pin 10 has a first part 11 and a second part 12. The second part 12 is at both ends of the first part 1. The diameter of the second part 12 is greater than the diameter of the first part 11 (the second part 12 is thicker than the first part 11).

As shown in FIG. 3 to FIG. 5, when the pin locker 30 abuts the cap 50 in the +Z direction by the biasing force of the spring 60, the step 13 between the first part 11 and the second part 12 of the connection pin 10 engages with the edge 30*b* of the pin insertion part 30*a* of the pin locker 30 (see FIG. 5, FIG. 10A to FIG. 10C). Thus, the connection pin 10 is locked by the pin locker 30. Hereinafter, "first position" refers to the position of the pin locker 30 abutting the cap 50 (the pin locker being held by the cap 50 in cooperation with the spring 60). In this embodiment, the edge(s) 30*b* of the pin insertion part 30*a* of the pin locker 30 corresponds to the pin engaging part that engages with the step 13 of the connection pin 10.

When the pin locker 30 is pushed into the recess 40 against the elastic power (biasing power) of the spring 60 through the opening 53 by the user, the pin locker 30 is moved to the second position (the position of the pin locker 30 shown in FIG. 6 and FIG. 7), which is further in the Z direction than the first position. When the pin locker 30 is at the second position, the step 13 is not caught by the edge 30*b* of the pin insertion part 30*a*, so that the entire connection pin 10 can pass through the pin insertion part 30*a*. Accordingly, the connection pin 10 can be taken out from the device-main-body-side insertion hole 21 (through insertion hole 20) to disconnect the band 3 from the device main body 2.

Hereinafter, the recess 40 of the band attachment part 2*a* and components of the band connection structure 100 are described in detail.

Recess

The recess 40 has the opening end 41 at the end of the recess 40 in the +Z direction; and a main part 42 at the −Z direction side of the opening end 41, as shown in FIG. 4 to FIG. 7. The main part 42 extends in the −Z direction beyond the device-main-body-side insertion hole 21. The recess 40 (main part 42) has a bottom 40*a* (wall) that is parallel with an X-Y plane. Part of the main part 42 crosses the device-main-body-side insertion hole 21. The lateral wall surface 42*a* of the main part 42 extends in the moving direction of the pin locker 30. The lateral wall surface 42*a* of the main part 42 of the recess 40 abuts the lateral surface 31*a* of the pin locker 30 (the lateral surface of the pin locker 30 that extends in the moving direction of the pin locker 30). The lateral surface 31*a* of the pin locker 30 is the first abutting part. The lateral wall surface 42*a* of the recess 40 is the first abutted part that is to be abutted by the lateral surface 31*a*. Conversely, the lateral wall surface 42*a* may be the first abutting part, and the lateral surface 31*a* may be the first abutted part.

Figure 8:
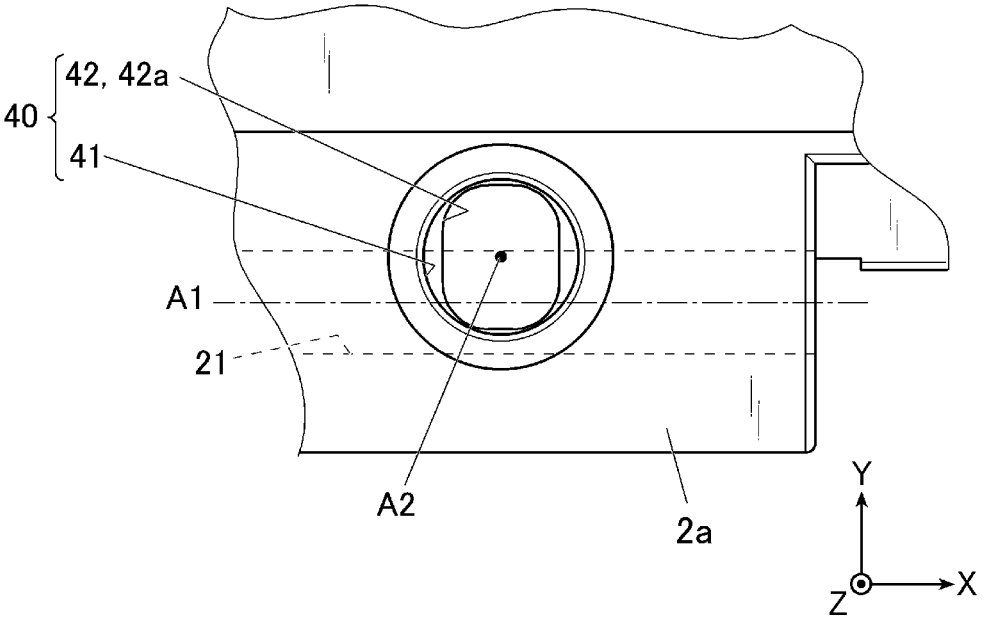
FIG. 8 shows a recess viewed in the +Z direction.

FIG. 8 shows the recess 40 viewed in the +Z direction. FIG. 8 shows the recess 40 from which the connection pin 10, the pin locker 30, the cap 50, and the spring 60 are removed. The width of the main part 42 in the X direction (first direction) is narrower than the width of the main part 42 in the Y direction (second direction) when viewed in the direction in which the central axis A2 extends (hereinafter called the central axis A2 direction). The main part 42 in this embodiment has a rounded rectangle shape that is elongated in the Y direction when viewed in the central axis A2 direction. That is, the main part 42 has a shape of a rounded-rectangle column cut out from the band attachment part 2*a*, the rounded-rectangle column having a rounded-rectangle shaped cross section perpendicular to the central axis A2. The lateral wall surface 42*a* has a shape of the lateral surface of a rounded-rectangle column. The main part 42 may have a shape of an elliptic cylinder cut out from the band attachment part 2*a*. In the case, the shape of the main part 42 viewed in the central axis A2 direction is an ellipse.

The opening end 41 of the recess 40 is circle-shaped and sized to fit to the external circumference of the cap 50 when viewed in the central axis A2 direction. In the cylindrical lateral wall surface of the opening end 41, screw grooves are formed for screwing the cap 50 into the opening end 41, as shown in FIG. 4 to FIG. 7.

As shown in FIG. 4, FIG. 6 and FIG. 8, the central axis A2 of the pin locker 30 disposed in the recess 40 does not intersect with the insertion axis A1 of the device-main-body-side insertion hole 21. The central axis A2 is separate in the +Y direction from the insertion axis A1.

Cap

Figure 9A:
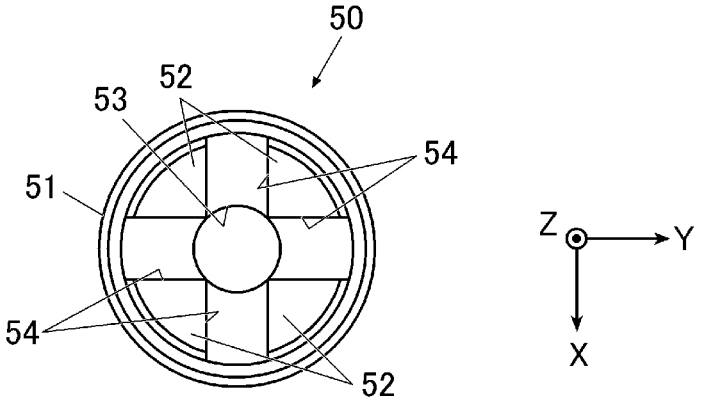
FIG. 9A shows a configuration of a cap.
Figure 9B:
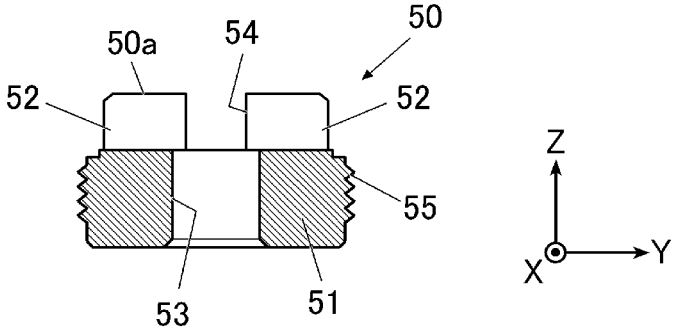
FIG. 9B shows the configuration of the cap.

FIG. 9A and FIG. 9B show the configuration of the cap 50.

FIG. 9A shows the cap 50 viewed in the +Z direction. FIG. 9B shows the cross section of the cap 50, wherein the cross section is along the center of the opening 53 and is perpendicular to the X direction.

The cap 50 has a substantially circular cylinder shape. The cap 50 has the base 51 in which the opening 53 is formed; and a protrusion 52 that protrudes from the base 51 in the moving direction of the pin locker 30 (Z direction). The opening 53 passes through the base 51 in the Z direction so as to connect the inside and the outside of the recess 40. The opening 53 is formed at the center of the cap 50 when viewed in the Z direction. The lateral wall surface of the opening 53 shown in FIG. 9A, FIG. 9B is cylindrical but is not limited thereto.

On the lateral surface of the base 51, screw threads 55 are formed. The screw threads 55 fit in the screw grooves formed in the lateral wall surface of the opening end 41 of the recess 40. With the screw threads 55, the base 51 of the cap 50 is screwed to the opening end 41 of the recess 40. The cap 50 is therefore attachable to and detachable from the opening end 41 of the recess 40. The state in which the cap 50 is attached to the opening end 41 is called the first state in which the cap 50 in cooperation with the spring 60 holds the pin locker 30.

In the top surface 50*a* of the protrusion 52 (the end surface in the +Z direction), which is opposite the spring 60 at the recess 40 side, a groove 54 is formed. The groove 54 fits to a tool (e.g., screwdriver) to be used for rotating the cap 50 to attach/detach the cap 50 to/from the opening end 41 of the recess 40. In this embodiment, the cross-shaped groove 54 is formed in the X and Y directions such that the groove 54 fits to a Phillips-head screwdriver. However, the shape of the groove 54 is not limited thereto. The groove 54 may have a straight-line shape that fits to a flathead screwdriver. The groove 54 may also have a different shape that fits to any other appropriate tool (e.g., a hexagon wrench). In the manufacturing process of the timepiece 1, the cap 50 is attached to the recess 40 in which the pin locker 30 and the spring 60 are housed. When the pin locker 30 and/or the spring 60 are broken or deteriorated, the cap 50 can be detached so that the pin locker 30 and/or the spring 60 can be taken out. This allows easy maintenance (repair and replacement of components). The state in which the cap 50 is detached from the opening end 41 is called the second state. In the second state, the pin locker 30 can be taken out from the recess 40. The cap 50 attached to the device main body 2 is in the first state, and the cap 50 detached from the device main body 2 is in the second state. That is, the state of the cap 50 can be selected from the first state and the second state.

Connection Pin

As shown in FIG. 3, FIG. 5 and FIG. 7, the connection pin 10, which is inserted to the device-main-body-side insertion hole 21 (through insertion hole 20), has the first part 11 and the second part 12. The first part 11 is round-column shaped and is at the center of the connection pin 10 in the X direction. The second part 12 is round-column shaped and is at both sides of the first part 11 in the X direction. The diameter of the second part 12 is greater than the diameter of the first part 11. Herein, the round column shape may include a round column shape the end(s) of which is tapered. In other words, the connection pin 10 is shaped to have a depressed part (first part 11) formed in a circle in the outer circumference direction such that the diameter of the first part 11 is smaller than the diameter of the adjacent second part 12. The connection pin 10 formed as described above has the step 13 at the boundary between the first part 11 and the second part 12. The step 13 has a shelf-like step surface that is perpendicular to the X direction. The length of the first part 11 in the X direction is slightly longer than the width of the pin locker 30 in the X direction. The connection pin 10 also has end surfaces 15 on its both ends (the ends of the second part 12 opposite the first part 11) in the longitudinal direction of the connection pin 10 (X direction in FIGS. 3, 5, 7). The end surfaces 15 are perpendicular to the longitudinal direction. At both ends of the connection pin 10, the corners of the end surfaces 15 are cut off to form tapered parts 14.

Pin Locker

Figure 10A:
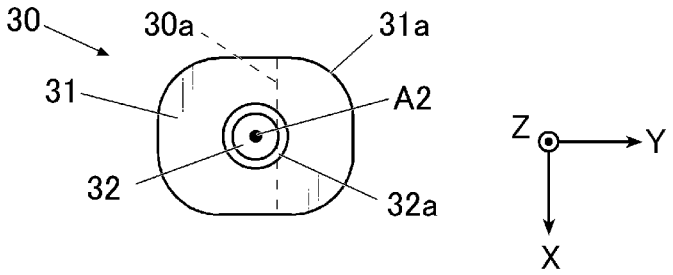
FIG. 10A shows a configuration of a pin locker.
Figure 10B:
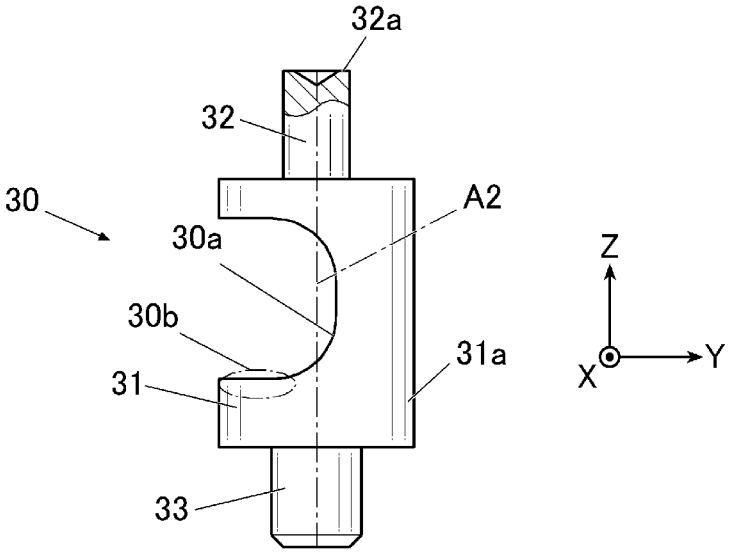
FIG. 10B shows the configuration of the pin locker.
Figure 10C:
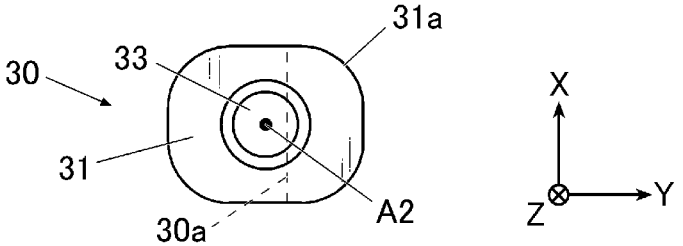
FIG. 10C shows the configuration of the pin locker.

FIG. 10A to FIG. 10C show the configuration of the pin locker 30.

The pin locker 30 has a main body 31, a push-in part 32 formed at the +Z direction side of the main body 31, and an abutting part 33 (second abutting part) at the −Z direction side of the main body 31. FIG. 10A to FIG. 10C show the central axis A2 of the pin locker 30.

The main body 31 has a shape of a rounded rectangular column in which the pin insertion part 30*a* (cut-out part) is formed. When viewed in the central axis A2 direction, the main body 31 has a shape of a rounded rectangle. As shown in FIG. 3 to FIG. 7, the lateral surface 31*a* of the main body 31 abuts the lateral wall surface 42*a* of the main part 42 of the recess 40. That is, the main body 31 of the pin locker 30 abuts the recess 40. The lateral surface 31*a* of the main body 31 of the pin locker 30 extends in the moving direction of the pin locker 30. When the pin locker 30 is at the first position, the top surface of the main body 31 that faces in the +Z direction abuts the bottom surface of the cap 50 that faces in the −Z direction. The width of the main body 31 in the X direction (first direction) is narrower than the width of the main body 31 in the Y direction (second direction) when viewed in the central axis A2 direction. The main body 31 is formed such that a certain space is secured between the main body 31 and the lateral wall surface 42*a* of the main part 42 of the recess 40 so that the pin locker 30 can smoothly move in the Z direction inside the recess 40. For example, the shape of the main body 31 viewed in the central axis A2 direction may be one size smaller than the shape of the lateral wall surface 42*a*, and may be similar to the shape of the lateral wall surface 42*a*. For example, when the shape of the main part 42 viewed in the central axis A2 direction is an ellipse, the shape of the main body 31 viewed in the central axis A2 direction is also an ellipse. In FIG. 3 to FIG. 7, the above-described space is not depicted because the space is narrow.

As shown in FIG. 6 and FIG. 7, the size and the position of the pin insertion part 30*a* is set such that the first part 11 and the second part 12 of the connection pin 10 can pass through the pin insertion part 30*a* when the pin locker 30 is at the second position. The pin insertion part 30*a* has the shape of part of a rounded rectangle column cut out from the main body 31. Herein, the axis of the rounded rectangle column is parallel with the insertion axis A1, perpendicular to the central axis A2, and separate from with the central axis A2.

The push-in part 32 is round-column shaped. The diameter of the push-in part 32 is smaller than the minor axis of the rounded rectangle of the main body 31. The diameter of the push-in part 32 is set such that the push-in part 32 can pass through the opening 53 of the cap 50. The push-in part 32 moves in the opening 53 of the cap 50 in the Z direction as the pin locker 30 moves in the Z direction in the recess 40.

As shown in FIG. 4, when the pin locker 30 is at the first position, the end surface 32*a* at the +Z direction side of the push-in part 32 is exposed through the opening 53 of the cap 50. When the pin locker 30 is at the first position, the end surface 32*a* of the push-in part 32 is closer to the spring 60 (the bottom 40*a* of the recess 40) than the top surface 50*a* of the protrusion 52 of the cap 50. In other words, when the pin locker 30 is at the first position, the position P2 of the end surface 32*a* of the push-in part 32 with respect to the Z direction is further inside the recess 40 than the position P1 of the top surface 50*a* of the cap 50, as shown in FIG. 4. The protrusion 52 of the cap 50 is located around the end surface 32*a*, which is exposed through the opening 53, when viewed in the moving direction of the pin locker 30 (Z direction).

As shown in FIG. 6 and FIG. 7, when the pin locker 30 is moved in the −Z direction to the second position, part of the push-in part 32 is inside the opening 53 of the cap 50. In other words, the push-in part 32 does not escape from the opening 53 of the cap 50 when the pin locker 30 is moved between the first position and the second position in the recess 40. That is, the end surface 32*a* of the push-in part 32 moves inside the opening 53 of the cap 50 in the central axis A2 direction when the pin locker 30 is moved between the first position and the second position in the central axis A2 direction.

In the end surface 32*a* of the push-in part 32, a dent is formed. The dent becomes deeper toward its center. The dent allows the user to easily push the end surface 32*a* of the push-in part 32 through the opening 53 by using a thin bar-shaped member, for example.

The abutting part 33 is round-column shaped. The diameter of the abutting part 33 is shorter than the minor axis of the rounded rectangle shape of the main body 31. The diameter of the abutting part 33 is also shorter than the inside diameter of the helical compression spring 60. The abutting part 33 is inside the spring 60. The abutting part 33 abuts the bottom 40*a* of the recess 40 when the pin locker 30 is at the second position. In other words, when the user pushes the pin locker 30 (push-in part 32) in the −Z direction until the abutting part 33 abuts the bottom 40*a* of the recess 40, the pin locker 30 is moved to the second position. Thus, the band connection structure 100 is in the connection pin unlocked state.

According to the pin locker 30 shaped as described above, the main body 31 is slightly smaller than the lateral wall surface 42*a* of the main part 42 of the recess 40 when viewed in the central axis A2 direction. Further, the shape of the main body 31 when viewed in the central axis A2 direction is not a perfect circle but a rounded rectangle. Thus, the rotation of the main body 31 on the central axis A2 is limited. That is, the recess 40 and the pin locker 30 is shaped such that the rotation of the pin locker 30 on the central axis A2 is limited in the recess 40. Specifically, the recess 40 and the pin locker 30 are shaped such that the rotation of the pin locker 30 on a virtual axis is limited in the recess 40, the virtual axis extending in the moving direction (Z direction) of the pin locker 30 and passing through the pin locker 30. Herein, the rotation of the pin locker 30 is limited such that the edge 30*b* (pin engaging part) of the pin insertion part 30*a* can engage with the step 13 of the connection pin 10. In another respect, the lateral surface 31*a* of the pin locker 30 abuts the lateral wall surface 42*a* of the recess 40, so that the rotation of the pin locker 30 on the virtual axis is limited in the recess 40, the virtual axis extending in the moving direction (Z direction) of the pin locker 30 and passing through the pin locker 30. Herein, the rotation of the pin locker 30 is limited such that the edge 30*b* (pin engaging part) of the pin insertion part 30*a* is allowed to engage with the step 13 of the connection pin 10. Further, the lateral surface 31*a* of the pin locker 30 abuts the lateral wall surface 42*a* of the recess 40, so that at least either of the following is limited when the pin locker 30 is at the second position (a specific position) in its moving direction (Z direction): the orientation of the pin insertion part 30*a* with respect to the through insertion hole 20 (device-main-body insertion hole 21); and the position of the pin insertion part 30*a* on a plane perpendicular to the moving direction (hereinafter called an X-Y plane). Herein, the orientation and/or the position of the pin insertion part 30*a* is limited such that the second part 12 of the connection pin 10 being inserted into the through insertion hole 21 (device-main-body side insertion hole 21) can pass through the pin insertion part 30*a*. Herein, the orientation of the pin insertion part 30*a* when the pin locker 30 is at the second position may include the orientation corresponding to the rotation of the pin locker 30. Further, the position of the pin insertion part 30*a* on the X-Y plane can be represented by the position of the central axis A2 of the pin locker 30 on the X-Y plane, for example. In the case described below, the above-described virtual axis matches with the central axis A2 of the pin locker 30. However, there may be a case where the virtual axis does not match with the central axis A2.

Figure 11A:
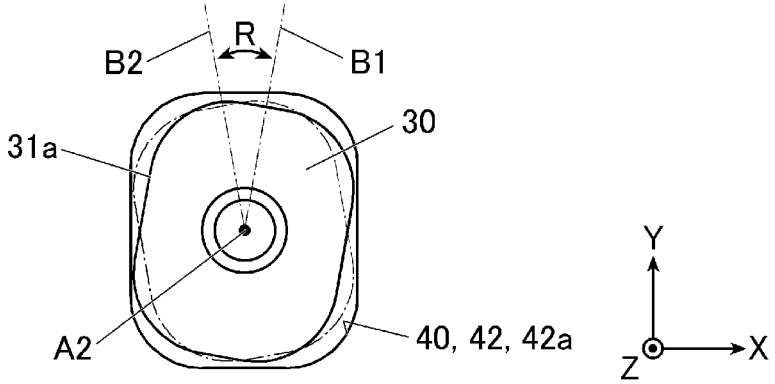
FIG. 11A is a figure to explain the limit of rotation of the pin locker and the limit of positions of the pin locker on an X-Y plane in the recess.
Figure 11B:
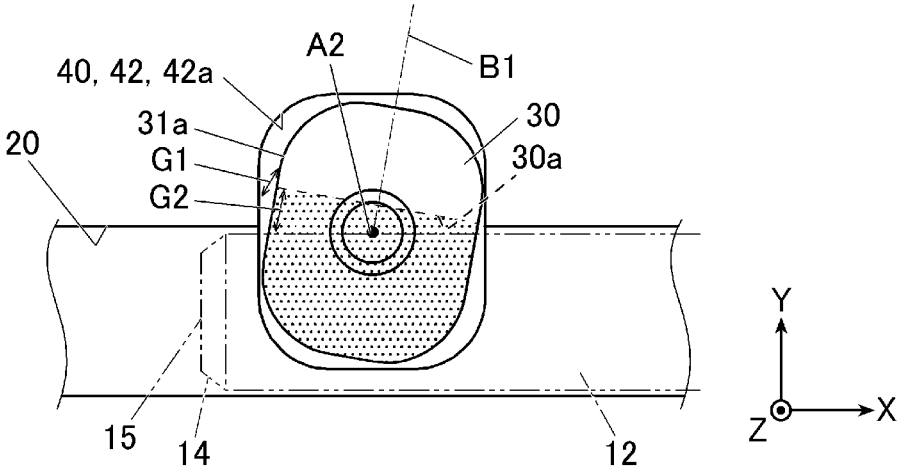
FIG. 11B is a figure to explain the limit of rotation of the pin locker and the limit of positions of the pin locker on the X-Y plane in the recess.
Figure 11C:
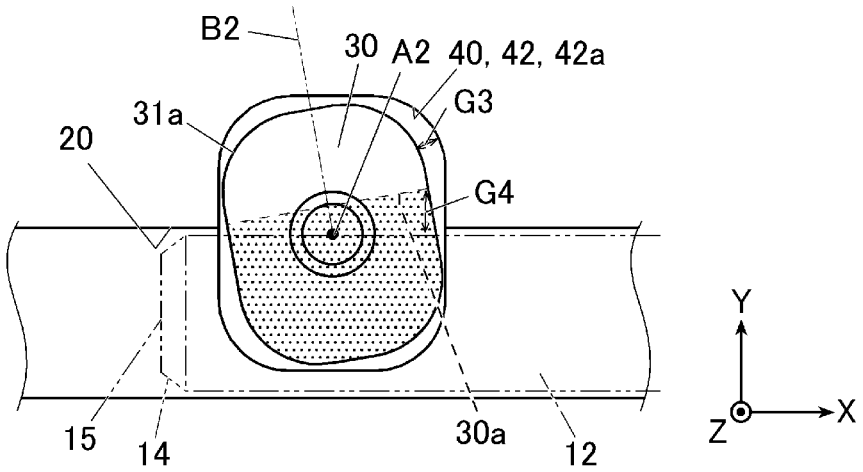
FIG. 11C is a figure to explain the limit of rotation of the pin locker and the limit of positions of the pin locker on the X-Y plane in the recess.

FIG. 11A to FIG. 11C are figures to explain the limit of rotation of the pin locker 30 and the limit of the position of the pin locker 30 on the X-Y plane in the recess 40. As a result of the rotation and the position on the X-Y plane of the pin locker 30 being limited, the orientation and the position on the X-Y plane of the pin insertion part 30*a* are limited. Each of FIG. 11A to FIG. 11C shows the cross section of the pin locker 30. The cross section in these figures is perpendicular to the central axis A2 of the pin locker 30 and is along the insertion axis A1 of the through insertion hole 20 (device-main-body-side insertion hole 21). In FIG. 11B and FIG. 11C, the hatched (dotted) region indicates the region of the pin insertion part 30*a*.

As shown in FIG. 11A, a space (play) is present between the lateral wall surface 42*a* of the recess 40 and the lateral surface 31*a* of the pin locker 30. Accordingly, the pin locker 30 can slightly rotate on the central axis A2 in the recess 40. In FIG. 11A, B1 indicates the direction of the major axis of the pin locker 30 (main body 31) when the pin locker 30 maximally rotates clockwise, and B2 indicates the direction of the major axis of the pin locker 30 when the pin locker 30 maximally rotates counterclockwise. The pin locker 30 can rotate within the rotatable range R between the state in which the major axis thereof is directed in B1 and the state in which the major axis thereof is directed in B2. For the purpose of illustration, the rotatable range R in FIG. 11A to FIG. 11C is exaggerated and is greater than the actual rotatable range.

Since there is a space (play) between the lateral wall surface 42*a* of the recess 40 and the lateral surface 31*a* of the pin locker 30, the position of the pin locker 30 on the X-Y plane can be slightly changed in the recess 40. In other words, the position of the central axis A2 of the pin locker 30 can shift. The position of the central axis A2 is likely to shift when the space (play) between the recess 40 and the pin locker 30 is designed to be great or when the space (play) between the recess 40 and the pin locker 30 is greater than the designed space owing to production variations of the recess 40 and/or the pin locker 30.

FIG. 11B shows the state in which the pin locker 30 maximally rotates clockwise. FIG. 11C shows the state in which the pin locker 30 maximally rotates counterclockwise. In FIG. 11B and FIG. 11C, dot-dash lines indicate an example of the position of the second part 12 of the connection pin 10 when the second part 12 is inserted through the pin insertion part 30*a*. In FIG. 11B, G1 indicates the space between the lateral surface 31*a* and the lateral wall surface 42*a* with respect to the rotation direction of the pin locker 30 on the central axis A2, and G2 indicates the space between the wall surface of the pin insertion part 30*a* and the second part 12 of the connection pin 10 inserted in the through insertion hole 20 (device-main-body-side insertion hole 21) with respect to the rotation direction of the pin locker 30. The size of the space G1 (the maximum of G1) is smaller than the size of the space G2 (the maximum of G2). In another aspect, the amount of rotation (maximum amount of rotation) of the lateral surface 31*a* with respect to the lateral wall surface 42*a* by the rotation of the pin locker 30 is smaller than the amount of rotation (maximum amount of rotation) of the wall surface of the pin insertion part 30*a* with respect to the second part 12 by the rotation of the pin locker 30. Further, in FIG. 11C, G3 indicates the space between the lateral surface 31*a* and the lateral wall surface 42*a* with respect to the direction perpendicular to the lateral wall surface 42*a* on a plane perpendicular to the moving direction (Z direction). In FIG. 11C, G4 indicates the space between the second part 12 and the wall surface of the pin insertion part 30*a* with respect to the direction perpendicular to the surface of the second part 12 on a plane that is perpendicular to the moving direction (Z direction) and that passes through the insertion axis A1. The spaces G3, G4 may occur when the pin locker 30 rotates on the central axis A2 or when the position of the central axis A2 shifts. The maximum possible size of the space G3 is smaller than the maximum possible size of the space G4.

Herein, the pin locker 30 has such a shape that allows the first part 11 and the second part 12 of the connection pin 10 to pass through the pin insertion part 30*a*, no matter in which direction within the rotatable range R the pin locker 30 is oriented when the pin locker 30 is at the second position. That is, in any state between the state shown in FIG. 11B (the major axis of the pin locker 30 is directed in B1) and the state shown in FIG. 11C (the major axis of the pin locker 30 is directed in B2), the through insertion hole 20 passes through the pin insertion part 30*a* (dotted region) cut out from the pin locker 30, and the through insertion hole 20 does not overlap the pin locker 30. Specifically, as a result of the lateral surface 31*a* abutting the lateral wall surface 42*a*, the orientation of the pin insertion part 30*a* with respect to the through insertion hole 20 (device-main-body-side insertion hole 21) is limited, and the position of the pin insertion part 30*a* on the X-Y plane is limited when the pin locker 30 is at the second position (a specific position). The orientation and the position on the X-Y plane of the pin insertion part 30*a* are limited such that the second part 12 of the connection pin 10 can pass through the pin insertion part 30*a*. In another respect, as a result of the lateral surface 31*a* abutting the lateral wall surface 42*a*, the orientation of the pin insertion part 30*a* with respect to the through insertion hole 20 (device-main-body-side insertion hole 21) is limited, and the position of the pin insertion part 30*a* on the X-Y plane is limited when the pin locker 30 is at the second position (a specific position). The orientation and position on the X-Y plane of the pin insertion part 30*a* are limited such that the pin locker 30 does not overlap the through insertion hole 20 (device-main-body-side insertion hole 21) when viewed in the X direction, in which the through insertion hole 20 (device-main-body-side insertion hole 21) extends. Thus, when the pin locker 30 is at the second position, the connection pin 10 can pass through the pin insertion part 30*a* without a need to adjust the orientation of the pin locker 30 in the rotation direction or the position of the pin locker 30 on the X-Y plane. Further, the space G1 is smaller than the space G2, and/or the space G3 is smaller than the space G4. According to such a configuration, the second part 12 of the connection pin 10 does not contact the pin locker 30 on the cross section shown in FIG. 11A to FIG. 11C, even when the pin locker 30 maximally rotates clockwise or counterclockwise.

FIG. 11A to FIG. 11C show how the orientation and the position on the X-Y plane of the pin insertion part 30*a* are limited when the lateral surface 31*a* abuts the lateral wall surface 42*a* as an example. Instead, either the orientation of the pin insertion part 30*a* or the position on the X-Y plane of the pin insertion part 30*a* may be restricted when the lateral surface 31*a* abuts the lateral wall surface 42*a*.

In another configuration, the connection pin 10 may not be allowed to pass through the pin insertion part 30*a* in some range around the one end or both ends of the rotatable range R. Even in such a configuration, the connection pin 10 can pass through the pin insertion part 30*a* in most of the rotatable range R. The direction of the pin locker 30 can therefore be adjusted relatively easily. The end surface 32*a* of the pin locker 30 may have a groove that fits to a tool for rotating the pin locker 30.

Spring

As shown in FIG. 4 to FIG. 7, the spring 60 is disposed between the bottom 40*a* of the recess 40 and the pin locker 30. The +Z direction-side end of the spring 60 is in contact with the −Z direction-side end surface of the main body 31 of the pin locker 30. The spring 60 applies elastic force to the pin locker 30 in the +Z direction. In a state where no external force is applied to the pin locker 30 in the −Z direction from outside the recess 40, the spring 60 biases the pin locker 30 in the +Z direction so that the pin locker 30 abuts the cap 50. When the pin locker 30 is pushed in the −Z direction through the opening 53, the spring 60 contracts in the Z direction by the force applied by the pin locker 30 in the −Z direction until the abutting part 33 of the pin locker 30 abuts the bottom 40*a* of the recess 40.

Connection Pin Locked State

Figure 12A:
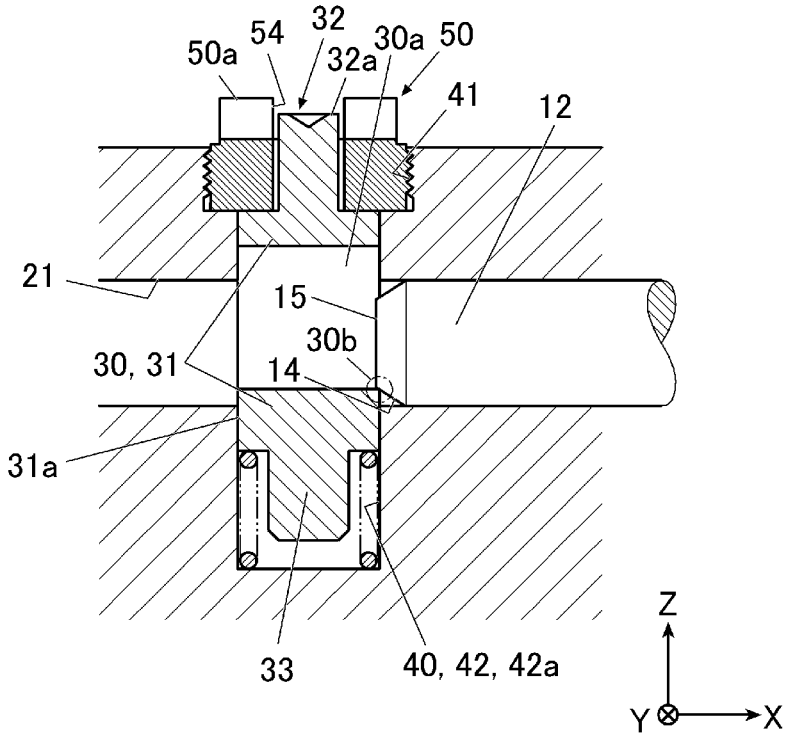
FIG. 12A shows the motion of the connection pin being inserted.
Figure 12B:
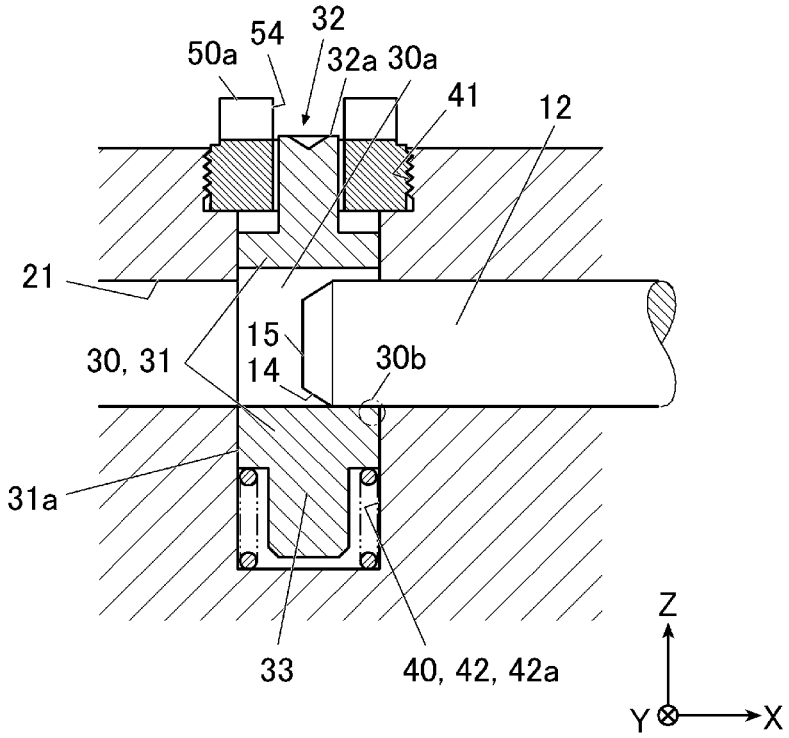
FIG. 12B shows the motion of the connection pin being inserted.

In a state where the recess 40 housing the pin locker 30 and the spring 60 is capped with the cap 50, the connection pin 10 is inserted through the through insertion hole 20. Accordingly, the band connection structure 100 is in the connection pin locked state, as shown in FIG. 3 to FIG. 5. Specifically, when the connection pin 10 is inserted through the through insertion hole 20 in a state where the pin locker 30 is at the first position, the tapered part 14 at the end of the connection pin 10 abuts the edge 30*b* of the pin insertion part 30*a*. The connection pin 10 is pushed further forward, and the tapered part 14 pushes down the edge 30*b* of the pin insertion part 30*a* in the −Z direction. Accordingly, the second part 12 of the connection pin 10 passes through the pin insertion part 30*a* as shown in FIG. 12B. Herein, the lateral surface 31*a* of the pin locker 30 abuts the lateral wall surface 42*a* of the recess 40. As a result, the orientation of the pin insertion part 30*a* with respect to the through insertion hole 20 (device-main-body-side insertion hole 21) is limited, and the position of the pin insertion part 30*a* on the X-Y plane is limited when the pin locker 30 is at the second position (a specific position). Herein, the orientation and the position on the X-Y plane of the pin insertion part 30*a* are limited such that the pin locker 30 does not abut the end surface 15 of the connection pin 10 when the connection pin 10 is inserted in the through insertion hole 20.

Instead of the above, the user may push the pin locker 30 (push-in part 32) in the −Z direction from outside the recess 40 through the opening 53 of the cap 50 to the second position or to a position between the first position and the second position, and the user may then insert the connection pin 10.

When the connection pin 10 is inserted in the −X direction in FIG. 12B until the first part 11 arrives at the pin insertion part 30*a*, the pin locker 30 is moved to the first position by the elastic force of the spring 60, as shown in FIG. 3 to FIG. 5. Accordingly, the edge 30*b* of the pin insertion part 30*a* engages with the step 13 of the connection pin 10, thereby locking the connection pin 10. In this connection pin locked state, only the first part 11 of the connection pin 10 can pass through the pin insertion part 30*a*, and the second part 12 is caught by the pin locker 30. In the state where the band attachment part 2*a* of the device main body 2 is fitted in the connection recess 3*b* of the attachment end part 3*a* of the band 3, the connection pin 10 is inserted through the through insertion hole 20 (connection pin locked state). Thus, the connection pin 10 does not come off from the through insertion hole 20, and the band 3 is connected to the device main body 2.

Connection Pin Unlocked State

In the connection pin locked state, the user may push the pin locker 30 (push-in part 32) in the −Z direction from outside the recess 40 through the opening 53 of the cap 50 and move the pin locker 30 until the abutting part 33 abuts the bottom 40*a* of the recess 40. As a result, the pin locker 30 is at the second position as shown in FIG. 6 and FIG. 7 (connection pin unlocked state). In this connection pin unlocked state, the edge 30*b* of the pin insertion part 30*a* does not engage with the step 13 of the connection pin 10, and the first part 11 and the second part 12 of the connection pin 10 can pass through the pin insertion part 30*a*. In other words, when the pin locker 30 is at the second portion, the first part 11 and the second part 12 can pass through the edge 30*b* of the pin insertion part 30*a* without engaging with the edge 30*b*. As described above, when the pin locker 30 is at the second position, the lateral surface 31*a* of the pin locker 30 abuts the lateral wall surface 42*a* of the recess 40, so that the range in which the pin locker 30 is rotatable (rotatable range R) and the position in the X-Y plane of the pin locker 30 are limited. Thus, when the pin locker 30 is at the second position, the second part 12 of the connection pin 10 can pass through the pin insertion part 30*a* without obstruction. The connection pin 10 can be pulled out from the through insertion hole 20 by being pushed in the X direction, and the band 3 can be disconnected from the device main body 2.

First Modification

Next, a first modification of the above embodiment is described. The shapes of the recess 40 and the pin locker 30 in the first modification are different from that in the above embodiment. Hereinafter, the aspects of the first modification different from the above embodiment are described, and the aspects in common with the above embodiment are not described.

Figure 13:
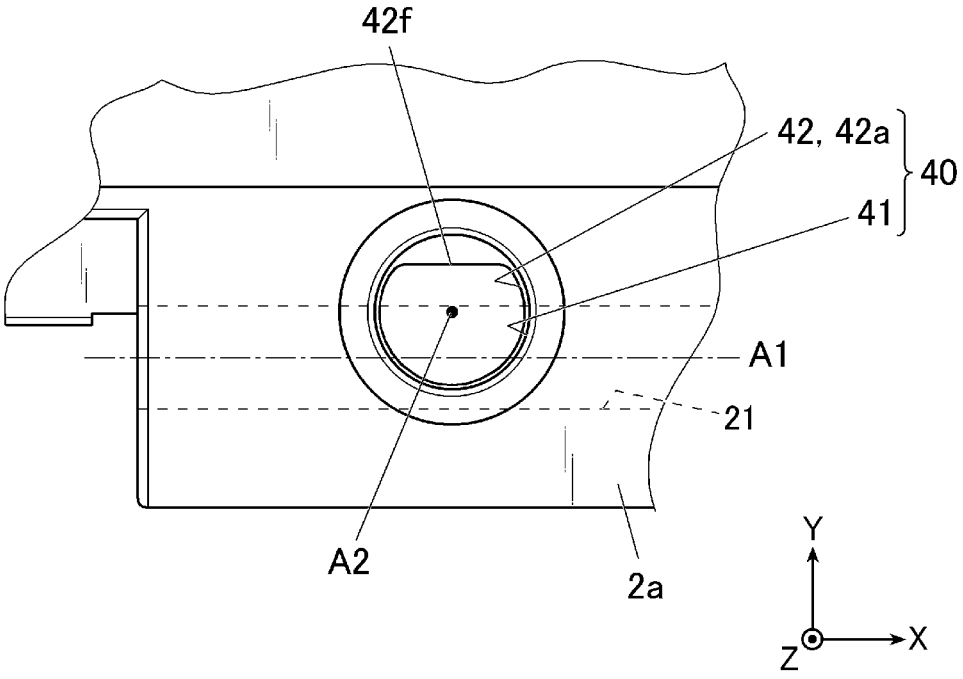
FIG. 13 shows the recess in a first modification viewed in the +Z direction.

FIG. 13 shows the recess 40 of the first modification viewed in the +Z direction.

In the first modification, the shape of the main part 42 (the part that abuts the pin locker 30) of the recess 40 is rotationally asymmetric when viewed in the central axis A2 direction. Herein, rotational asymmetry means that there is no number "n" (n≠1) that meets the following: after the shape is rotated on the central axis A2 by 360/n degrees, the shape looks the same as the original shape. Specifically, the shape of the main part 42 consists of a part of a circle and a chord of the circle when viewed in the central axis A2 direction. That is, the shape of the lateral wall surface 42*a* of the main part 42 is a combination of a cylinder and a flat surface 42*f*. Specifically, on part of the lateral surface of the cylinder, the flat surface 42*f* is provided that is parallel with the central axis A2 and that is separate from the central axis A2. On the lateral wall surface 42*a* of the main part 42, the flat surface 42*f* and the curved surface may be smoothly connected so as not to form a ridge.

Figure 14A:
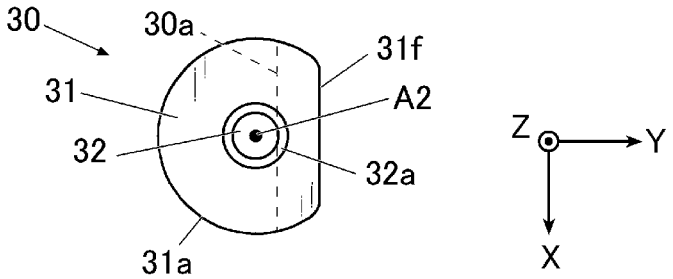
FIG. 14A shows a configuration of the pin locker in the first modification.
Figure 14B:
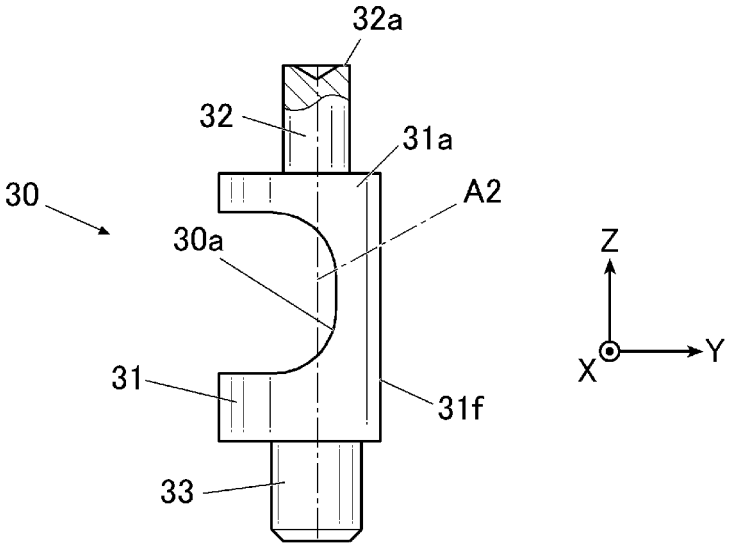
FIG. 14B shows the configuration of the pin locker in the first modification.
Figure 14C:
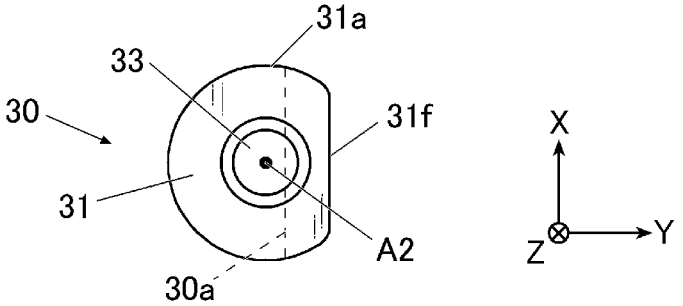
FIG. 14C shows the configuration of the pin locker in the first modification.

FIG. 14A to FIG. 14C show a configuration of the pin locker 30 in the first modification.

In the first modification, the shape of the main body 31 of the pin locker 30 (the part that abuts the recess 40) is rotationally asymmetric when viewed in the central axis A2 direction. Specifically, the shape of the main body 31 consists of a part of a circle and a chord of the circle when viewed in the central axis A2 direction. That is, the shape of the main body 31 is a round column part of which is cut out along a flat surface 31*f*. The flat surface 31*f* is parallel with the central axis A2 and separate from the central axis A2. On the lateral surface 31*a* of the main body 31, the flat surface 31*f* and the curved surface may be smoothly connected so as not to form a ridge. The main body 31 is shaped such that a certain space is secured between the main body 31 and the lateral wall surface 42*a* of the main part 42 of the recess 40 so that the pin locker 30 can smoothly move in the Z direction inside the recess 40. For example, the shape of the main body 31 viewed in the central axis A2 direction may be one size smaller than the lateral wall surface 42*a* of the main part 42.

As described above, the shapes of the recess 40 and the pin locker 30 are rotationally asymmetric. With such shapes, the pin locker 30 can enter the recess 40 only when the pin locker 30 is oriented in a specific direction (including directions in the rotatable range due to the above-described space). In other words, the direction of the pin locker 30 in the recess 40 is limited to a specific direction. The specific direction is the direction in which the flat surface 31*f* of the pin locker 30 faces the flat surface 42*f* of the recess 40. The position and the region of the pin insertion part 30*a* is determined such that the pin insertion part 30*a* connects through to the device-main-body-side insertion hole 21 (through insertion hole 20) when the pin locker 30 is in the specific direction in the recess 40. The pin locker 30 is oriented so as to fit in the recess 40 and housed in the recess 40. Thus, the pin insertion part 30*a* can be easily aligned with the device-main-body-side insertion hole 21. For example, in FIG. 3, if the pin insertion part 30*a* is rotated by 180 degrees on the central axis A2 and then housed in the recess 40, the pin insertion part 30*a* faces in the +Y direction and is not aligned with the device-main-body-side insertion hole 21. The first modification can avoid such a circumstance.

The shapes of the recess 40 and the pin locker 30 are not limited to the shapes shown in FIG. 13 and FIG. 14A to FIG. 14C, as long as the shapes are rotationally asymmetric when viewed in the central axis A2 direction. For example, the shapes may consist of a part of an ellipse and a chord of the ellipse when viewed in the central axis A2 direction. Further, the shapes of the recess 40 and the pin locker 30 do not have to be similar to each other when viewed in the central axis A2 direction. For example, either the recess 40 or the pin locker 30 may have a protrusion part, and the other may have a depression part that fits to the protrusion part when viewed in the central axis A2 direction. The protrusion part corresponds to one of "the first abutting part" and "the first abutted part", and the depression part corresponds to the other of "the first abutting part" and "the first abutted part".

Second Modification

Next, a second modification of the above embodiment is described. One of the differences between the second modification and the above embodiment is that, in the second modification, the recess 40 is formed in the attachment end part 3*a* of the band 3. The second modification may be combined with the first modification.

Figure 15:
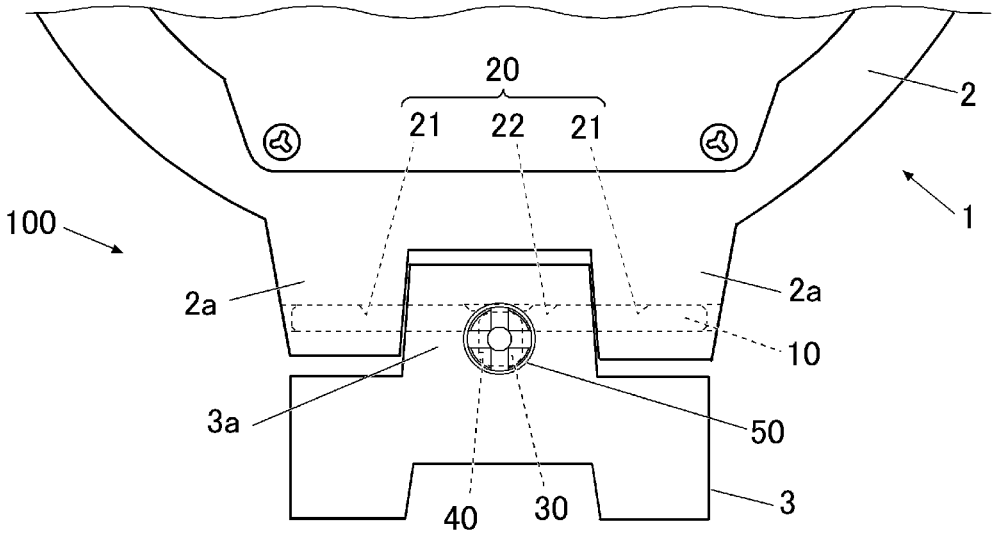
FIG. 15 shows a configuration of the timepiece and the band connection structure in a second modification.

FIG. 15 shows the timepiece 1 and the band connection structure 100 in the second modification.

In the second modification, the attachment end part 3*a* of the band 3 has the connection protrusion, and the band attachment part 2*a* of the device main body 2 has the connection recess that fits to the attachment end part 3*a* of the band 3. In the attachment end part 3*a*, the band-side insertion hole 22 is formed. Each of leading ends of the band attachment part 2*a* has a device-main-body-side insertion hole 21. The device-main-body-side insertion holes 21 connect through to the band-side insertion hole 22, thereby forming the through insertion hole 20. The connection pin 10 is inserted in the through insertion hole 20. In the second modification, the recess 40 is formed in the attachment end part 3*a*. The recess 40 houses the pin locker 30 and the spring 60. To the opening end 41 of the recess 40, the cap 50 is attached. The structure of the band connection structure 100 except the position of the recess 40 is the same as the structure of the above embodiment.

Third Modification

Next, a third modification of the above embodiment is described. The structure of the cap 50 in the third modification is different from that in the above embodiment. The third modification may be combined with at least either the first modification or the second modification.

Figure 16:
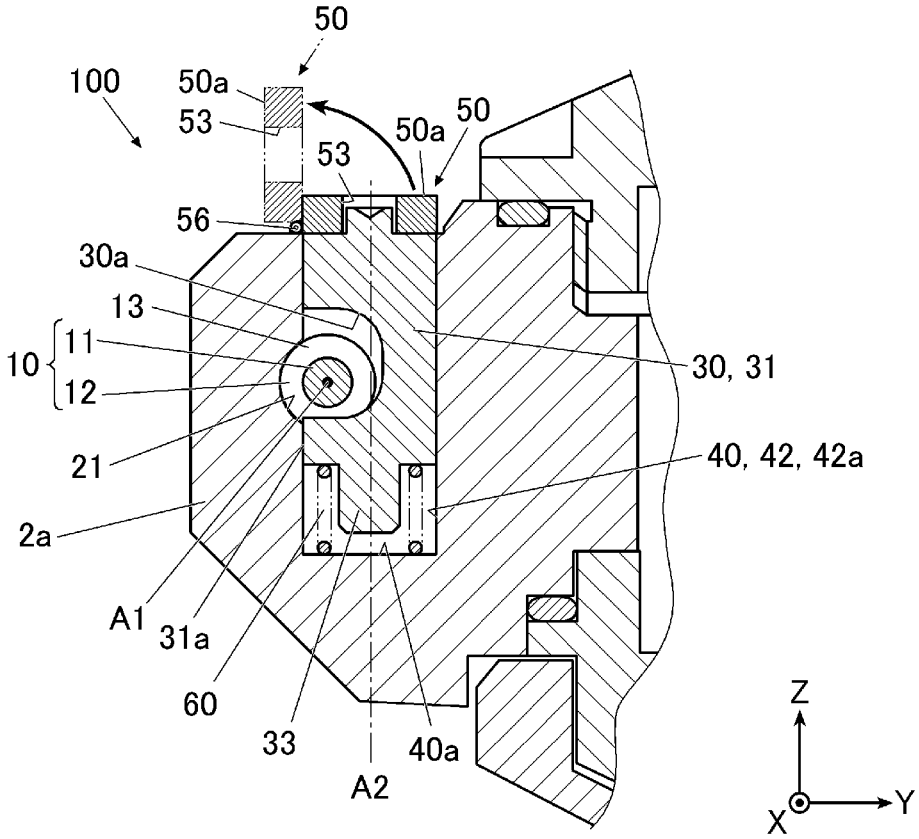
FIG. 16 shows a cross section of the band connection structure in a third modification, the cross section being perpendicular to the X direction.

FIG. 16 shows a cross section of the band connection structure in a third modification, the cross section being perpendicular to the X direction.

As shown in FIG. 16, the cap 50 in the third modification has a hinge 56 fixed to the band attachment part 2*a* of the device main body 2. The cap 50 is swingable on the hinge 56. Specifically, the cap 50 can swing between (i) the state of covering the opening of the recess 40 (shown by the solid line in FIG. 16) and (ii) the state of opening the opening of the recess 40 (shown by the dashed line in FIG. 16). The edge of the cap 50 opposite the hinge 56 has a not-illustrated catch (e.g., a snap) that is configured to fasten the edge to the band attachment part 2*a* and hold the cap 50 in the state of covering the recess 40 (the state shown by the solid line). The cap 50 fastened by the catch holds the pin locker 30 against the biasing force of the spring 60. The state of the cap 50 covering the opening of the recess 40, which is shown by the solid line, corresponds to "the first state" in which the cap 50 holds the pin locker 30 in cooperation with the spring 60. The state of the cap 50 opening the opening of the recess 40, which is shown by the dash line, corresponds to "the second state" in which the pin locker 30 can be taken out from the recess 40. By swinging the cap 50 on the hinge 56, the state of the cap 50 can be selected from the first state and the second state.

The cap 50 is not limited to the one that is swingable on the hinge 56. For example, the cap 50 may be a slidable shutter that is slidable in the direction parallel with the X-Y plane in FIG. 16.

Advantageous Effects

As described above, the connection structure 100 in this embodiment includes the connection pin 10 and the pin locker 30. The connection pin 10 includes the first part 11 and the second part 12 between which the step 13 is formed, the second part 12 being thicker than the first part 11, and connects the device main body 2 (first connection target) and the band 3 (second connection target) by being inserted in the device-main-body-side insertion hole 21 of the device main body 2 and the band-side insertion holes 22 of the band 3. The pin locker 30 is movable in the moving direction (Z direction) in the recess 40 formed in the device main body 2, the moving direction being different from the direction in which the device-main-body-side insertion hole 21 extends; has the edge 30*b* (pin engaging part) that is configured to engage with the step 13 of the connection pin 10; and has the pin insertion part 30*a* having a size that allows the connection pin 10 to pass through, a part of the edge 30*b* of the pin insertion part 30*a* being the pin engaging part. The pin locker 30 has the lateral surface 31*a* (first abutting part), and the recess 40 has the lateral wall surface 42*a* (first abutted part) to be abutted by the lateral surface 31*a*. When the pin locker 30 is at the second position (specific position) in the moving direction (Z direction) and when the lateral surface 31*a* abuts the lateral wall surface 42*a*, at least either the orientation of the pin insertion part 30*a* with respect to the through insertion hole 20 (device-main-body-side insertion hole 21) or the position of the pin insertion part 30*a* on an X-Y plane perpendicular to the moving direction (Z direction) is limited such that the second part 12 of the connection pin 10 being inserted in the through insertion hole 20 (the device-main-body-side insertion hole 21) is allowed to pass through the pin insertion part 30*a*.

According to the above configuration, the orientation and the position on the X-Y plane of the pin locker 30 is limited. Thus, the pin locker 30 can be placed such that the connection pin 10 can pass through the pin insertion part 30*a* (i.e., such that the step 13 of the connection pin 10 can engage with the edge 30*b* of the pin insertion part 30*a*). In the known structure in which the rotation of the pin locker is not limited, the pin locker needs to be arranged and held beforehand such that the pin locker 30 is appropriately oriented and positioned on the X-Y plane. As compared with the known structure, the band connection structure 100 allows the connection pin 10 to be easily inserted into the through insertion hole 20 to engage with the pin locker 30. Thus, the band 3 can be easily connected to the device main body 2.

Further, when the lateral surface 31*a* abuts the lateral wall surface 42*a*, rotation of the pin locker 30 on the central axis A2 (virtual axis) in the recess 40 may be limited such that the second part 12 of the connection pin 10 being inserted in the through insertion hole 20 (device-main-body-side insertion hole 21) is allowed to pass through the pin insertion part 30*a*, the central axis A2 extending in the moving direction and passing through the pin locker 30. Thus, when there is some play that allows the pin locker 30 to rotate, the above configuration limits the rotation of the pin locker 30 and prevents the pin locker 30 from engaging with the connection pin 10 and blocking the insertion of the connection pin 10.

Further, the size of the space G1 between the lateral surface 31*a* and the lateral wall surface 42*a* with respect to the rotation direction of the pin locker 30 may be smaller than the size of the space G2 between the second part 12 of the connection pin 10 inserted in the device-main-body-side insertion hole 21 and the wall surface of the pin insertion part 30*a* with respect to the rotation direction of the pin locker 30. According to the above configuration, the second part 12 of the connection pin 10 does not contact the wall surface of the pin insertion part 30*a* even when the pin locker 30 maximally rotates in the rotation direction. Thus, the above configuration can surely avoid the circumstance in which the second part 12 of the connection pin 10 cannot pass through the device-main-body-side insertion hole 21 owing to the rotation of the pin locker 30 in the recess 40.

Further, the maximum size of the space G3 between the lateral surface 31*a* and the lateral wall surface 42*a* with respect to the direction perpendicular to a surface of the lateral wall surface 42*a* on a plane perpendicular to the moving direction (Z direction) may be smaller than the maximum size of the space G4 between the second part 12 and the wall surface of the pin insertion part 30*a* with respect to a direction perpendicular to the surface of the second part 12 of the connection pin 10 inserted in the device-main-body-side insertion hole 21 on a plane that is perpendicular to the moving direction (Z direction) and that passes the central axis A2. According to the above configuration, the second part 12 of the connection pin 10 is less likely to contact the wall surface of the pin insertion part 30*a* when the pin locker 30 rotates or when the central axis A2 shifts. Thus, the above configuration can surely avoid the circumstance in which the second part 12 of the connection pin 10 cannot pass through the device-main-body-side insertion hole 21 owing to the rotation of the pin locker 30 in the recess 40.

Further, the connection pin 10 may have the end surface 15 that is perpendicular to the longitudinal direction of the connection pin 10. When the pin locker 30 is at the second position in the moving direction and when the lateral surface 31*a* abuts the lateral wall surface 42*a*, at least either the orientation of the pin insertion part 30*a* with respect to the through insertion hole 20 (the device-main-body-side insertion hole 21) or the position of the pin insertion part 30*a* on an X-Y plane perpendicular to the moving direction (Z direction) is limited such that the pin locker 30 does not abut the end surface 15 of the connection pin 10 being inserted in the through insertion hole 20 (device-main-body-side insertion hole 21). Thus, the above configuration can surely avoid the circumstance in which the second part 12 of the connection pin 10 cannot pass through the device-main-body-side insertion hole 21 owing to the rotation of the pin locker 30 in the recess 40.

Further, when the pin locker 30 is at the second position in the moving direction and when the lateral surface 31*a* abuts the lateral wall surface 42*a*, at least either the orientation of the pin insertion part 30*a* with respect to the through insertion hole 20 (device-main-body-side insertion hole 21) or the position of the pin insertion part 30*a* on an X-Y plane perpendicular to the moving direction may be limited such that the pin locker 30 does not overlap the device-main-body-side insertion hole 21 when viewed in a direction in which the through insertion hole 20 (device-main-body-side insertion hole 21) extends. Thus, the above configuration can surely avoid the circumstance in which the second part 12 of the connection pin 10 cannot pass through the device-main-body-side insertion hole 21 owing to the rotation of the pin locker 30 in the recess 40.

Further, the first abutting part may be the lateral surface 31*a* of the main body 31 of the pin locker 30, the lateral surface 31*a* extending in the moving direction. The first abutted part is the lateral wall surface 42*a* of the main part 42 of the recess 40, the lateral wall surface 42*a* extending in the moving direction and being to be abutted by the lateral surface 31*a* of the pin locker 30. The lateral surface 31*a* of the pin locker 30 and the lateral wall surface 42*a* of the recess 40 have an ellipse shape or a rounded rectangle shape when viewed in the moving direction. With the recess 40 and the pin locker 30 having shapes easy to form, the movable range of the pin locker 30 in the first and second directions in the recess 40 is limited to a narrow range, and the rotation of the pin locker 30 on the central axis A2 is limited.

Further, in the band connection structure 100 in the first modification, the lateral surface 31*a* of the pin locker 30 and the lateral wall surface 42*a* of the recess 40 may have a shape that is rotationally asymmetric when viewed in the moving direction. According to the above configuration, the pin locker 30 fits in the recess 40 only when the pin locker 30 is oriented in a specific direction. The pin locker 30 is oriented to fit in the recess 40 and then housed in the recess 40, so that the pin insertion part 30*a* is aligned with the through insertion hole 20.

Further, the lateral surface 31*a* of the pin locker 30 and the lateral wall surface 42*a* of the recess 40 may have a shape consisting of a part of a circle and a chord of the circle or have a shape consisting of a part of an ellipse and a chord of the ellipse when viewed in the moving direction. With the recess 40 and the pin locker 30 having shapes easy to form, the orientation of the pin locker 30 in the recess 40 can be limited to a specific orientation.

Further, the pin locker 30 may be movable in the recess 40 in the moving direction between the first position and the second position, the second position being the specific position different from the first position. The connection structure 100 may further include: the spring 60 (bias) that biases the pin locker 30 in a single direction along the moving direction; and the cap 50 (holder) that is disposed on the device main body 2 and that holds the pin locker 30 at the first position in cooperation with the spring 60. When the pin locker 30 is positioned at the first position by the spring 60 and the cap 50, the step 13 of the connection pin 10 engages with the edge 30*b* of the pin insertion part 30*a*. When the pin locker 30 is positioned at the second position by a user's manipulation against a biasing force of the spring 60, the second part 12 of the connection pin 10 is allowed to pass through the pin insertion part 30*a*.

According to the above configuration, the connection pin 10 that has been locked by the pin locker 30 can be unlocked by simply moving the pin locker 30 against the biasing force of the spring 60. By unlocking and pulling out the connection pin 10 from the through insertion hole 20, the band 3 is disconnected from the device main body 2, and the band 3 can be replaced. Thus, the band 3 can be replaced with a simple manipulation without specific tools or skills.

Further, in the above configuration, the connection pin 10 is locked when its step 13 between the first part 11 and the second part 12 engages with the edge 30*b* of the pin insertion part 30*a* of the pin locker 30. Such a configuration can secure a broader contact area between the pin locker 30 and the connection pin 10. Thus, the connection pin 10 can be surely locked. The connection pin 10 is unlikely to be unlocked when the band connection structure 100 receives an impact. Therefore, unexpected detachment of the band 3 can be prevented.

Further, the pin locker 30 includes the abutting part 33 (second abutting part) that abuts the bottom 40*a* (inside wall) of the recess 40 when the pin locker 30 is at the second position, the bottom 40*a* crossing the moving direction. According to the above configuration, the connection pin 10 can be unlocked by simply pushing the pin locker 30 to the second position until the abutting part 33 abuts the bottom 40*a* of the recess 40.

Further, the spring 60 (bias) is a helical compression spring, and the abutting part 33 is disposed inside the spring 60. Thus, the recess 40 and the band connection structure 100 can be made compact.

Further, the central axis A2 of the pin locker 30 is separate from the insertion axis A1 of the through insertion hole 20 when viewed in the direction in which the through insertion hole 20 extends, the central axis A2 being at the center of the cross section perpendicular to the moving direction of the pin locker 30, the insertion axis A1 being at the center of the cross section perpendicular to the direction in which the through insertion hole 20 extends. The pin engaging part is the edge 30*b* of the pin insertion part 30*a* (cut-out portion) of the pin locker 30, the pin insertion part 30*a* (cut-out portion) being formed at least on an insertion axis side of the pin locker 30. According to the above configuration, the maximum width of the pin locker 30 in the direction perpendicular to the central axis A2 is made smaller, as compared with a configuration in which the central axis A2 intersects the insertion axis A1 at a single point and in which the pin engaging part is the edge of the hole that passes through the pin locker 30 in the X direction. Thus, the pin locker 30 can be made compact. Further, the diameter of the connection pin 10 does not have to be shorter than the maximum width of the pin locker 30. Therefore, the connection pin 10 can be designed more flexibly.

Further, the timepiece 1 (wearable device) in the embodiment includes: the device main body 2 as the first connection target; the band 3 as the second connection target to be used for attaching the device main body to an object; and the band connection structure 100 as described above. According to the above configuration, the band 3 can be replaced by a simple manipulation. Further, according to the above configuration, the rotation of the pin locker 30 is restricted in the recess 40, so that the connection pin 10 can be easily inserted through the through insertion hole 20. Therefore, the band 3 can be easily connected to the device main body 2.

Others

The embodiment described above is an example of the connection structure and the wearable device according to the present invention and does not limit the present invention.

For example, although the wearable device is the timepiece 1 as an example, the wearable device is not limited to this. The wearable device may be any device that is used by being worn on the body of the user, such as a healthcare device (e.g., activity monitor).

The first connection target is not limited to the device main body 2 of the timepiece 1, and the second connection target is not limited to the band 3 of the timepiece 1. For example, the first and second connection targets may be links that constitute the band 3. That is, the connection structure may be used for connecting the links constituting the band 3.

Although the cap 50 is screwed into the device main body 2 or the band 3 as an example, the method of attaching the cap 50 is not limited thereto. The cap 50 can be attached by any method in which the cap 50 is attachable and detachable without damaging the cap 50 and the part of the device main body 2 or the band 3 to which the cap 50 is attached (in the above embodiment, the opening end 41). For example, the cap 50 may be attached to the opening end 41 of the recess 40 by a snap-fit method, in which a protrusion part and a depression part are formed in the opening end 41 and the cap 50, respectively and the protrusion part is fitted in the depression part.

The holder is not limited to the cap 50, which is attached to the opening end 41 of the recess 40. The holder may be positioned and shaped as desired as long as being able to restrict the movement of the pin locker 30 in the recess 40. For example, the holder may be a member attached to the lateral wall surface of the recess 40 or a protrusion member formed on the lateral wall surface of the recess 40.

Although the recess 40 extends in the Z direction as an example, the present invention is not limited to this. The direction in which the recess 40 extends may be angled with respect to the Z direction.

In the above embodiment, the insertion axis A1 of the through insertion hole 20 is separate from the central axis A2 of the pin locker 30 in the recess 40 as an example. Instead, the insertion axis A1 may intersect with the central axis A2 at a single point. In such a case, the pin locker 30 has a through hole that allows the connection pin 10 being inserted in the through insertion hole 20 to pass through the center of the pin locker 30 in the recess 40.

In the above embodiment, the pin locker 30 has the pin insertion part 30*a*, and the edge 30*b* of the pin insertion part 30*a* corresponds to the pin engaging part. The present invention is not limited to this, though. For example, the pin locker may have, at its leading end, a protrusion-shaped pin engaging part that engages with the step 13 of the connection pin 10.

The depressed part formed on the connection pin 10 as the first part 11 does not have to be formed in a circle in the outer circumferential direction of the connection pin 10. The depressed part may be formed as a partial circle in the outer circumferential direction. For example, when the pin locker has the protrusion-shaped pin engaging part, the connection pin may at least have a depressed part that is sized to fit to the pin engaging part.

The through insertion hole 20 may not pass through the band attachment part 2*a* of the device main body 2 and the attachment end part 3*a* of the band 3. One end of the through insertion hole 20 may be blocked (in the configuration in FIG. 2, the end of either one of the band-side insertion holes 22 opposite the device-main-body-side insertion hole 21 may be blocked). In such a case, the second part 12 may be formed on only one side of the first part 11 of the connection pin 10, the one side corresponding to the blocked end of the insertion hole 20. According to the above configuration, the movement of the connection pin 10 toward the blocked end is limited by the blocked end, and the movement of the connection pin 10 in the direction opposite the blocked end is limited by the pin locker 30 that engages with the step 13.

The bias is the helical compression spring 60 as an example but is not limited thereto. The bias may be a spring other than a coil spring or may be a member made of an elastic material (e.g., silicon). The bias may also be a tension spring that is attached to the pin locker 30 and the cap 50 between the pin locker 30 and the cap 50. The bias may also be a member that magnetically biases the pin locker 30 toward the cap 50. The tension spring may be or may not be attachable to and detachable from the pin locker 30 and the cap 50.

In the above description, the push-in part 32 of the pin locker 30 is pushed in the −Z direction in order to move the pin locker 30 from the first position to the second position. Instead, the pin locker 30 may be pulled in the −Z direction from the side opposite the cap 50 in order to move the pin locker 30. In such a case, a through hole may be formed in part of the bottom 40*a* of the recess 40 in the direction opposite the opening end 41 side, and a member connected to the pin locker 30 may be drawn out through the through hole so that the user can pull the pin locker 30.

In the above description, the abutting part 33 of the pin locker 30 abuts the bottom 40*a* (wall of the recess 40) that has a flat surface parallel with the X-Y plane as an example. However, the wall is not limited to this. The wall of the recess 40 may have any shape that can be abutted by the abutting part 33 of the pin locker 30. At part of the bottom of the recess 40, a through hole may be formed that passes through to the side opposite the opening end 41 of the recess 40.

In the above description, the cap 50 is attachable and detachable as an example. The present invention, however, is not limited to this. The cap 50 may be adhered to the opening end 41 of the recess 40 so as not to be attachable or detachable. The cap 50 may be formed as a part of the band attachment part 2*a* (as a part of the attachment end part 3*a* in the second modification, the same applies hereinafter). That is, the cap 50 may be integrated with the band attachment part 2*a*.

The cap 50 may be omitted. Even if the cap 50 is omitted, the pin locker 30 does not escape from the recess 40 in the connection pin locked state because the connection pin 10 is inserted through the pin locker 30.

In the above embodiment, the lateral surface 31*a* of the main body 31 of the pin locker 30 corresponds to one of "the first abutting part" and "the first abutted part", and the lateral wall surface 42*a* of the recess 40 corresponds to the other of "the first abutting part" and "the first abutted part". The present invention, however, is not limited to this.

For example, the lateral surface of the push-in part 32 of the pin locker 30 may abut the lateral wall surface of the opening 53 of the cap 50, so that at least either (i) the orientation of the pin insertion part 30*a* with respect to the through insertion hole 20 (device-main-body-side insertion hole 21) or (ii) the position of the pin insertion part 30*a* on the X-Y plane (the plane perpendicular to the moving direction: Z direction) may be limited, when the pin locker 30 is at the second position (a specific position) in the moving direction (Z direction). Herein, the orientation or the position on the X-Y plane of the pin insertion part 30*a* is limited such that the second part 12 of the connection pin 10, which is being inserted in the through insertion hole 20 (device-main-body-side insertion hole 21), can pass through the pin insertion part 30*a*. In such a case, the lateral surface of the push-in part 32 of the pin locker 30 corresponds to one of "the first abutting part" and "the first abutted part", and the lateral wall surface of the opening 53 of the cap 50 corresponds to the other of "the first abutting part" and "the first abutted part". Therefore, "the recess part" described in the claim set includes the opening 53 of the cap 50.

Naturally, the detailed configurations and operations of the components constituting the timepiece 1 and the band connection structure 100 in the above embodiment can be appropriately modified without departing from the scope of the present invention.

Although the embodiment of the present invention has been described, the scope of the present invention is not limited to the embodiment described above but encompasses the scope of the invention recited in the claims and the equivalent thereof.

What is claimed is:

1. A connection structure comprising:

a connection pin that includes a first part and a second part between which a step is formed, the second part being thicker than the first part, and that connects a first connection target and a second connection target by being inserted in an insertion hole of the first connection target and an insertion hole of the second connection target;

a pin locker that is movable in a moving direction in a recess formed in one of the first connection target and the second connection target, the moving direction being different from a direction in which the through hole of the one of the first connection target and the second connection target extends, that has a pin engaging part that is configured to engage with the step of the connection pin, and that has a pin insertion part having a size that allows the connection pin to pass through, a part of an edge of the pin insertion part being the pin engaging part; and a bias that biases the pin locker in a single direction along the moving direction, wherein:

one of the recess and the pin locker has a first abutting part, and another of the recess and the pin locker has a first abutted part to be abutted by the first abutting part, when the pin locker is at a specific position in the moving direction and when the first abutting part abuts the first abutted part, at least either an orientation of the pin insertion part with respect to the insertion hole or a position of the pin insertion part on a plane perpendicular to the moving direction is limited such that the second part of the connection pin being inserted in the insertion hole is allowed to pass through the pin insertion part, the pin locker is movable in the recess in the moving direction between a first position and a second position, the second position being the specific position different from the first position, includes a second abutting part that abuts an inside wall of the recess when the pin locker is at the second position, the inside wall crossing the moving direction, the bias is a helical compression spring, and the second abutting part is disposed inside the helical compression spring.

2. The connection structure according to claim 1, wherein when the first abutting part abuts the first abutted part, rotation of the pin locker on a virtual axis in the recess is limited such that the second part of the connection pin being inserted in the insertion hole is allowed to pass through the pin insertion part, the virtual axis extending in the moving direction and passing through the pin locker.

3. The connection structure according to claim 2, wherein a size of a space between the first abutting part and the first abutted part with respect to a rotation direction of the pin locker is smaller than a size of a space between the second part of the connection pin inserted in the insertion hole and a wall surface of the pin insertion part with respect to the rotation direction of the pin locker.

4. The connection structure according to claim 1, wherein a maximum size of a space between the first abutting part and the first abutted part with respect to a direction perpendicular to a surface of the first abutted part on a plane perpendicular to the moving direction is smaller than a maximum size of a space between the second part and a wall surface of the pin insertion part with respect to a direction perpendicular to a surface of the second part of the connection pin inserted in the insertion hole on a plane that is perpendicular to the moving direction and that passes through a center of the insertion hole.

5. The connection structure according to claim 1, wherein the connection pin has an end surface that is perpendicular to a longitudinal direction of the connection pin, and wherein, when the pin locker is at the specific position in the moving direction and when the first abutting part abuts the first abutted part, at least either an orientation of the pin insertion part with respect to the insertion hole or a position of the pin insertion part on a plane perpendicular to the moving direction is limited such that the pin locker does not abut the end surface of the connection pin being inserted in the insertion hole.

6. The connection structure according to claim 1, wherein when the pin locker is at the specific position in the moving direction and when the first abutting part abuts the first abutted part, at least either an orientation of the pin insertion part with respect to the insertion hole or a position of the pin insertion part on a plane perpendicular to the moving direction is limited such that the pin locker does not overlap the insertion hole when viewed in a direction in which the insertion hole extends.

7. The connection structure according to claim 1, wherein:

the first abutting part is a lateral surface of the pin locker, the lateral surface extending in the moving direction, the first abutted part is a lateral wall surface of the recess, the lateral wall surface extending in the moving direction and being to be abutted by the lateral surface of the pin locker, and the lateral surface of the pin locker and the lateral wall surface of the recess have an ellipse shape or a rounded rectangle shape when viewed in the moving direction.

8. The connection structure according to claim 1, wherein:

the first abutting part is a lateral surface of the pin locker, the lateral surface extending in the moving direction, the first abutted part is a lateral wall surface of the recess, the lateral wall surface extending in the moving direction and being to be abutted by the lateral surface of the pin locker, and the lateral surface of the pin locker and the lateral wall surface of the recess have a shape that is rotationally asymmetric when viewed in the moving direction.

9. The connection structure according to claim 8, wherein the lateral surface of the pin locker and the lateral wall surface of the recess have a shape consisting of a part of a circle and a chord of the circle or have a shape consisting of a part of an ellipse and a chord of the ellipse when viewed in the moving direction.

10. The connection structure according to claim 1, wherein the connection structure further includes a holder that is disposed on the one of the first connection target and the second connection target and that holds the pin locker at the first position in cooperation with the bias, wherein when the pin locker is positioned at the first position by the bias and the holder, the step of the connection pin engages with the pin engaging part, and wherein when the pin locker is positioned at the second position by a user's manipulation against a biasing force of the bias, the second part of the connection pin is allowed to pass through the pin insertion part.

11. The connection structure according to claim 2, wherein the pin locker is movable in the recess in the moving direction between a first position and a second position, the second position being the specific position different from the first position, wherein the connection structure further includes:

a bias that biases the pin locker in a single direction along the moving direction; and a holder that is disposed on the one of the first connection target and the second connection target and that holds the pin locker at the first position in cooperation with the bias, wherein when the pin locker is positioned at the first position by the bias and the holder, the step of the connection pin engages with the pin engaging part, and wherein when the pin locker is positioned at the second position by a user's manipulation against a biasing force of the bias, the second part of the connection pin is allowed to pass through the pin insertion part.

12. The connection structure according to claim 3, wherein the pin locker is movable in the recess in the moving direction between a first position and a second position, the second position being the specific position different from the first position, wherein the connection structure further includes:

a bias that biases the pin locker in a single direction along the moving direction; and a holder that is disposed on the one of the first connection target and the second connection target and that holds the pin locker at the first position in cooperation with the bias, wherein when the pin locker is positioned at the first position by the bias and the holder, the step of the connection pin engages with the pin engaging part, and wherein when the pin locker is positioned at the second position by a user's manipulation against a biasing force of the bias, the second part of the connection pin is allowed to pass through the pin insertion part.

13. The connection structure according to claim 4, wherein the pin locker is movable in the recess in the moving direction between a first position and a second position, the second position being the specific position different from the first position, wherein the connection structure further includes:

a bias that biases the pin locker in a single direction along the moving direction; and a holder that is disposed on the one of the first connection target and the second connection target and that holds the pin locker at the first position in cooperation with the bias, wherein when the pin locker is positioned at the first position by the bias and the holder, the step of the connection pin engages with the pin engaging part, and wherein when the pin locker is positioned at the second position by a user's manipulation against a biasing force of the bias, the second part of the connection pin is allowed to pass through the pin insertion part.

14. The connection structure according to claim 5, wherein the pin locker is movable in the recess in the moving direction between a first position and a second position, the second position being the specific position different from the first position, wherein the connection structure further includes:

a bias that biases the pin locker in a single direction along the moving direction; and a holder that is disposed on the one of the first connection target and the second connection target and that holds the pin locker at the first position in cooperation with the bias, wherein when the pin locker is positioned at the first position by the bias and the holder, the step of the connection pin engages with the pin engaging part, and wherein when the pin locker is positioned at the second position by a user's manipulation against a biasing force of the bias, the second part of the connection pin is allowed to pass through the pin insertion part.

15. The connection structure according to claim 6, wherein the pin locker is movable in the recess in the moving direction between a first position and a second position, the second position being the specific position different from the first position, wherein the connection structure further includes:

a bias that biases the pin locker in a single direction along the moving direction; and a holder that is disposed on the one of the first connection target and the second connection target and that holds the pin locker at the first position in cooperation with the bias, wherein when the pin locker is positioned at the first position by the bias and the holder, the step of the connection pin engages with the pin engaging part, and wherein when the pin locker is positioned at the second position by a user's manipulation against a biasing force of the bias, the second part of the connection pin is allowed to pass through the pin insertion part.

16. The connection structure according to claim 7, wherein the pin locker is movable in the recess in the moving direction between a first position and a second position, the second position being the specific position different from the first position, wherein the connection structure further includes:

a bias that biases the pin locker in a single direction along the moving direction; and a holder that is disposed on the one of the first connection target and the second connection target and that holds the pin locker at the first position in cooperation with the bias, wherein when the pin locker is positioned at the first position by the bias and the holder, the step of the connection pin engages with the pin engaging part, and wherein when the pin locker is positioned at the second position by a user's manipulation against a biasing force of the bias, the second part of the connection pin is allowed to pass through the pin insertion part.

17. The connection structure according to claim 1, wherein a central axis of the pin locker is separate from an insertion axis of the insertion hole when viewed in a direction in which the insertion hole extends, the central axis being at a center of a cross section perpendicular to the moving direction of the pin locker, the insertion axis being at a center of a cross section perpendicular to the direction in which the insertion hole extends, and wherein the pin engaging part is an edge of a cut-out portion of the pin locker, the cut-out portion being formed at least on an insertion axis side of the pin locker.

18. A wearable device comprising:

a device main body as the first connection target;

a band as the second connection target to be used for attaching the device main body to an object; and the connection structure according to claim 1.

* * * * *